US007591385B2

(12) United States Patent
Brooks

(10) Patent No.: US 7,591,385 B2
(45) Date of Patent: Sep. 22, 2009

(54) SYSTEM FOR HOLDING IMPLEMENTS

(75) Inventor: Jeffrey S. Brooks, St. Louis, MO (US)

(73) Assignee: Dr. Brooks Innovations, LLC, St. Louis, MO (US)

( * ) Notice: Subject to any disclaimer, the term of this patent is extended or adjusted under 35 U.S.C. 154(b) by 0 days.

(21) Appl. No.: 11/568,621

(22) PCT Filed: May 6, 2005

(86) PCT No.: PCT/US2005/015955

§ 371 (c)(1),
(2), (4) Date: Nov. 3, 2006

(87) PCT Pub. No.: WO2005/107536

PCT Pub. Date: Nov. 17, 2005

(65) Prior Publication Data

US 2008/0006592 A1 Jan. 10, 2008

Related U.S. Application Data

(60) Provisional application No. 60/568,742, filed on May 6, 2004.

(51) Int. Cl.
*A47F 7/00* (2006.01)

(52) U.S. Cl. ..... 211/94.01; 211/70.6

(58) Field of Classification Search ..... 211/89.01, 211/94.01, 70.6, 66, 90.01, 87.01; 108/106–108; 220/751; 248/220.21, 224.7, 311.2, 274.1, 248/276.1, 287.1
See application file for complete search history.

(56) References Cited

U.S. PATENT DOCUMENTS 152,955 A 7/1874 Sleeper
277,510 A 5/1883 Roberts
345,917 A 7/1886 Packer
391,438 A 10/1888 Horn
569,640 A 10/1896 Hartzell
723,677 A 3/1903 Kade
984,857 A 2/1911 Schuftan
1,009,679 A 11/1911 McFadden
1,037,915 A 9/1912 Hyde
1,065,045 A 6/1913 Hartmann (Continued)

OTHER PUBLICATIONS

StoreWALL Catalog, Undated, 2 Pages.

(Continued)

*Primary Examiner*—Jennifer E. Novosad
(74) *Attorney, Agent, or Firm*—Senniger Powers LLP

(57) ABSTRACT

A system for holding one or more implements. The system includes a wall-mounted rail having a channel-track extending lengthwise of the rail, and an implement holder having a track-engaging element slidable in the channel-track to a selected position on the rail. Fastener holes are spaced at intervals along the bottom wall of the channel-track for receiving one or more rail fasteners to mount the rail. One implement holder comprises a jar assembly which includes a jar for storing items and a bracket mountable on the rail for holding the jar. Other implement holders may also be used, including an implement holder with a snap-lock fastener for releasable snap-fastening interconnection with the rail. A support places the holder at a different position relative to the rail. A wall mounted bracket may be used for supporting the holder.

5 Claims, 23 Drawing Sheets

U.S. PATENT DOCUMENTS

| | | | | |
|---|---|---|---|---|
| 1,133,696 | A | 3/1915 | Barbora | |
| 2,754,009 | A | 7/1956 | Kennedy | |
| 2,915,832 | A | 12/1959 | Phillips | |
| 2,937,766 | A | 5/1960 | Penn | |
| 3,178,141 | A | 4/1965 | Bloom | |
| 3,179,255 | A | 4/1965 | De'Caccia | |
| 3,374,990 | A | 3/1968 | Gray | |
| 3,592,384 | A | 7/1971 | Tomaro | |
| 3,603,274 | A | 9/1971 | Ferdinand | |
| 3,765,344 | A | 10/1973 | Ferdinand | |
| 3,794,183 | A | 2/1974 | Colbridge | |
| D250,076 | S | 10/1978 | Aust | |
| 4,155,460 | A | 5/1979 | Ratti | |
| 4,161,279 | A | 7/1979 | Halford | |
| 4,203,373 | A | 5/1980 | Conti | |
| 4,339,102 | A | 7/1982 | Schweitzer | |
| 4,341,312 | A | 7/1982 | Scholer | |
| 4,348,001 | A | 9/1982 | Baldwin | |
| 4,349,171 | A | 9/1982 | Baldwin | |
| 4,401,222 | A | 8/1983 | Kulikowski | |
| 4,453,641 | A | 6/1984 | Rasmussen | |
| 4,457,436 | A | 7/1984 | Kelley | |
| 4,467,925 | A | 8/1984 | Ratzloff | |
| 4,509,648 | A * | 4/1985 | Govang et al. | 211/70.6 |
| 4,597,554 | A | 7/1986 | James | |
| 4,618,192 | A | 10/1986 | Kelley | |
| 4,776,482 | A | 10/1988 | Wolters | |
| 4,811,670 | A | 3/1989 | Kolvites | |
| 4,852,747 | A | 8/1989 | Breveglieri | |
| 4,871,074 | A | 10/1989 | Bryson | |
| 4,942,498 | A * | 7/1990 | Toussaint | 361/709 |
| 5,123,549 | A | 6/1992 | Finses | |
| 5,386,959 | A | 2/1995 | Laughlin | |
| 5,447,243 | A | 9/1995 | Graber | |
| 5,586,687 | A | 12/1996 | Spamer | |
| 5,641,091 | A | 6/1997 | Daneshvar | |
| 5,687,856 | A | 11/1997 | Kendrena | |
| 5,740,927 | A | 4/1998 | Yemini | |
| 5,743,414 | A * | 4/1998 | Baudino | 211/69.1 |
| 5,779,145 | A | 7/1998 | Zelle | |
| 5,887,731 | A * | 3/1999 | Thalenfeld | 211/57.1 |
| 5,921,411 | A | 7/1999 | Merl | |
| 6,138,583 | A | 10/2000 | Mahone | |
| 6,305,557 | B1 * | 10/2001 | Brooks | 211/70.6 |
| 6,349,911 | B1 | 2/2002 | Feldpausch | |
| 6,394,404 | B1 | 5/2002 | Cyrell | |
| 6,431,373 | B1 * | 8/2002 | Blick | 211/70.6 |
| 6,450,338 | B1 * | 9/2002 | Chen | 206/378 |
| 6,488,151 | B2 * | 12/2002 | Ramsey et al. | 206/378 |
| 6,497,395 | B1 | 12/2002 | Croker | |
| 6,540,093 | B1 | 4/2003 | Shumway | |
| 6,637,605 | B2 * | 10/2003 | Ernst | 211/70.6 |
| 6,666,419 | B1 | 12/2003 | Vrame | |
| 6,698,603 | B2 | 3/2004 | Lawson | |
| 7,175,034 | B2 * | 2/2007 | Nook et al. | 211/189 |
| 7,341,231 | B2 * | 3/2008 | Zarn | 248/225.11 |
| 2003/0015444 | A1 * | 1/2003 | Molin et al. | 206/366 |
| 2003/0019775 | A1 * | 1/2003 | Ernst | 206/378 |
| 2003/0234231 | A1 * | 12/2003 | Rowe | 211/90.02 |
| 2005/0029210 | A1 * | 2/2005 | Perkins et al. | 211/94.01 |
| 2005/0263465 | A1 | 12/2005 | Chung | |
| 2006/0175274 | A1 * | 8/2006 | Yang | 211/94.01 |
| 2007/0017886 | A1 * | 1/2007 | Kao | 211/94.01 |
| 2007/0102381 | A1 * | 5/2007 | Nguy et al. | 211/70.6 |
| 2007/0256996 | A1 | 11/2007 | Jackle | |
| 2008/0006592 | A1 | 1/2008 | Brooks | |
| 2008/0041800 | A1 * | 2/2008 | Kao | 211/70.6 |
| 2008/0047911 | A1 * | 2/2008 | Kao | 211/70.6 |

OTHER PUBLICATIONS

Gladiator Garage Works Brochure, Undated, 1 Page.
Suncast Catalog, Undated, 2 Pages.
Office Action dated Apr. 18, 2008 regarding U.S. Appl. No. 11/104,835, 24 pages.
PCT International Search Report for International Application No. PCT/US05/15955 dated Jan. 4, 2008 (5 pages).

* cited by examiner

SYSTEM FOR HOLDING IMPLEMENTS

CROSS-REFERENCE TO RELATED APPLICATIONS

The present application is based on and claims the benefit of International (PCT) Application Serial No. PCT/US 2005/015955 filed on May 6, 2005. The PCT application claims priority from Provisional Patent Application No. 60/568,742, filed May 6, 2004. The entire contents of these applications are incorporated herein by reference.

BACKGROUND OF THE INVENTION

This invention relates generally to devices for holding tools, utensils, household products and other consumer items, such items hereinafter being referred to generally as "implements". In particular, this invention is an improvement on the invention disclosed in my U.S. Pat. No. 6,305,557 which is hereby incorporated by reference in its entirety.

SUMMARY OF THE INVENTION

Among the several objects of exemplary embodiments of this invention may be noted the provision of a unique system for holding and organizing various implements, including but not limited to those noted above; the provision of an exemplary system which is relatively inexpensive and easy to assemble and use; and the provision of an exemplary system which can be expanded as needed to accommodate greater numbers and/or different types of implements.

In one aspect, a system of this invention for holding one or more implements comprises a rail adapted to be mounted on a generally vertical mounting surface. An implement holder is configured to hold the one or more implements. The holder has at least one snap-lock fastener for snap-fastening engagement with the rail to releasably fasten the holder at a fastened position on the rail.

In another aspect, a funnel-shaped holder of the invention is for holding an implement and which is configured for snap-fastening attachment to a wall mount having at least one edge for engagement by the holder. The holder comprises a funnel structure having an upper end that flares open upwardly and is relatively wide for receiving the implement, a lower end that is relatively narrow, a rear wall with an inside surface and an outside surface, and opposite converging side walls which define, in conjunction with the rear wall, a funnel-shaped recess for holding the implement in a stored position. A first fastening formation projects rearward of the rear wall for engagement with the wall mount. A second fastening formation projects rearward of the rear wall and is positioned in spaced relation from the first fastening formation for engagement with the wall mount. At least one of the first and second fastening formations comprises a snap-lock fastening formation configured for releasable snap-fastening interconnection with the wall mount.

Further, a support of the invention is for releasably supporting an implement holder on a rail mounted on a wall. The support comprises a rail fastening section having a snap-fastening formation configured for releasable snap-fastening engagement with the rail. A holder mounting section is for releasably mounting the holder on the support. The holder mounting section has a vertical platform connected adjacent its upper end to the rail fastening section.

In another aspect, a system of the invention is for holding one or more implements. The system comprises a wall mount adapted to be mounted on a generally vertical mounting surface. An implement holder is configured to hold the one or more implements. The holder has at least one snap-lock fastener for snap-fastening engagement with the wall mount to releasably fasten the holder at a fastened position on the wall mount.

In still a further aspect, a rail of the invention is adapted to be mounted in a generally horizontal position on a generally vertical mounting surface. The rail has a channel-track extending lengthwise of the rail. An implement holder having a track-engaging element is receivable in the channel-track and is slidable along the channel-track to a selected position on the rail. Each channel-track comprises a bottom wall adapted to be positioned generally adjacent the mounting surface, a pair of spaced-apart side walls extending forward from the bottom wall, and a slot at a front side of the channel-track whereby when the track-engaging element of the implement holder is received in the channel-track between the side walls thereof, the track-engaging element is adapted to project forward through the slot and to be slidably moved along the slot to move the implement holder to its desired position. Fastener holes are spaced at intervals along the bottom wall of the channel-track for receiving one or more rail fasteners to mount the rail on said mounting surface. The channel-track has a depth sufficient to provide clearance between the track-engaging element and the one or more rail fasteners when the rail is mounted on said surface whereby the track-engaging element may be slidably moved along the channel-track without interference with the one or more rail fasteners.

In another aspect, the invention is directed to a jar assembly comprising a jar having a bottom, one or more sides, and a mouth. The assembly also includes a bracket comprising a back wall, a pair of generally opposing, spaced-apart sides extending forward from the back wall, and opposing jar supports on the sides of the bracket for supporting the jar in an upright position for storage of items in the jar. Optionally, the bracket has a track-engaging element thereon for engaging a track on a rail to permit sliding movement of the bracket along the rail.

Other objects and features will be in part apparent and in part pointed out hereinafter.

BRIEF DESCRIPTION OF THE DRAWINGS

Corresponding parts are designated by corresponding numbers throughout the drawings.

DETAILED DESCRIPTION

Figure 1:
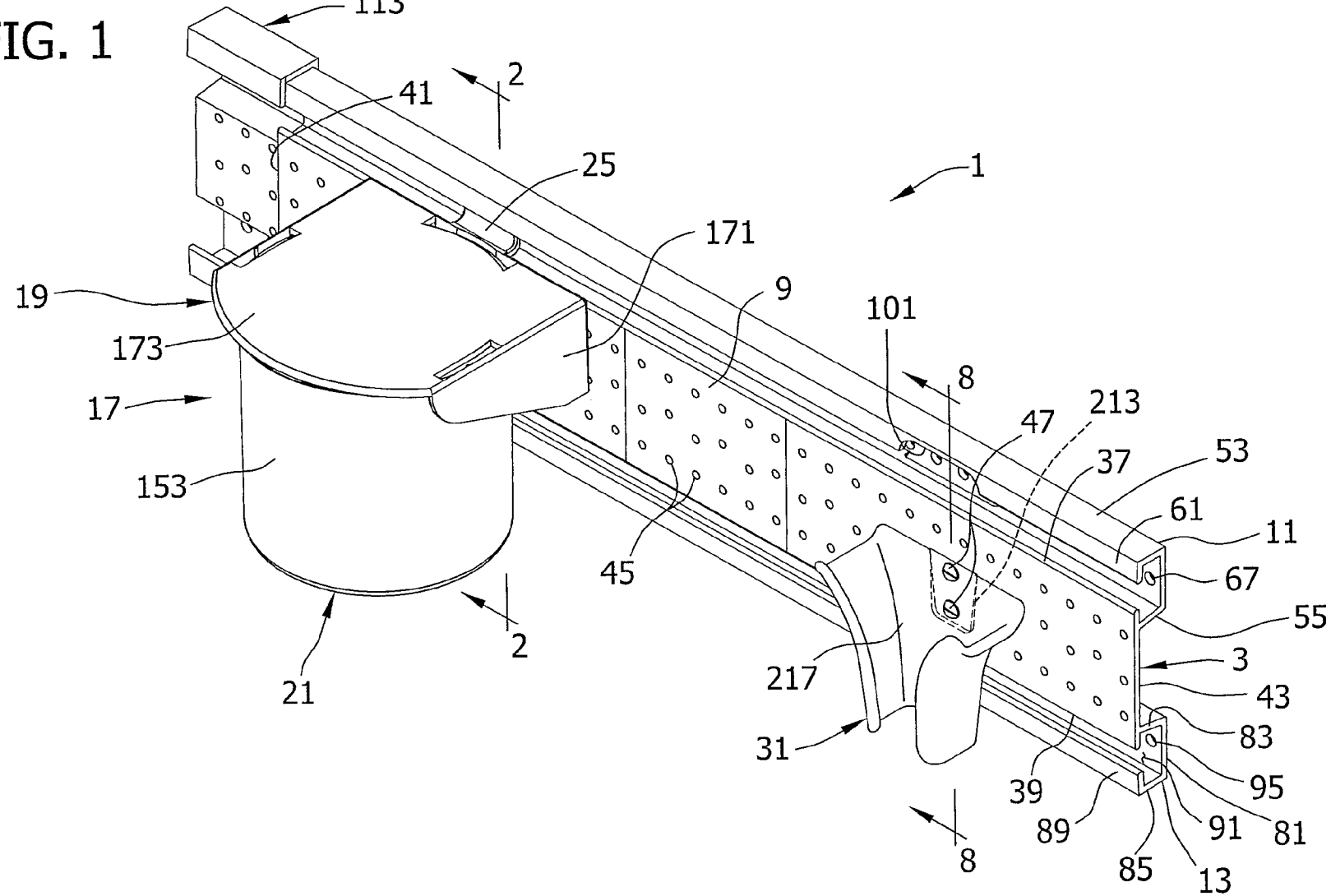
FIG. 1 is a perspective of a system of the present invention comprising a rail with a jar assembly and a funnel-shaped holder mounted on the rail.
Figure 2:
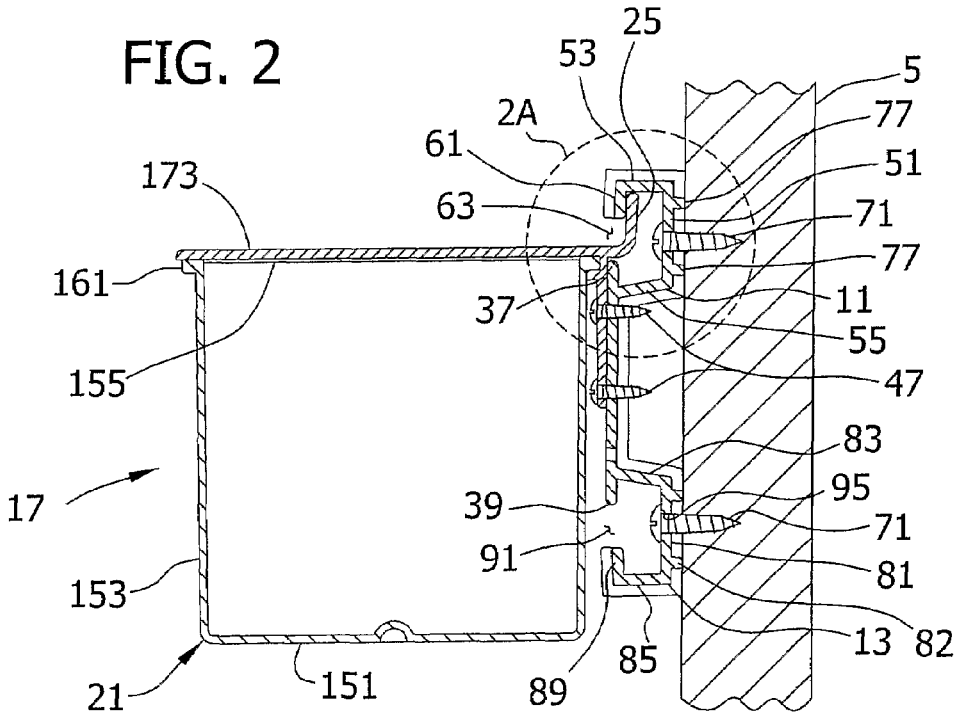
FIG. 2 is a vertical section of the rail and jar assembly along line 2-2 of FIG. 1.

Referring now to the drawings, FIGS. 1 and 2 show one embodiment of a system of this invention, designated in its entirety by the reference numeral 1. As shown, the system comprises one or more rails, each generally designated 3, adapted to be mounted in a generally horizontal position on a generally vertical mounting surface 5 (FIG. 2). The mounting surface can be a pegboard, wall studs, a wall or any other type of surface suitable for mounting the one or more rails. In the illustrated embodiment, each rail (only one is shown in FIG. 1) comprises an elongate rail panel 9 and one or more channel-tracks on the rail panel, two such channel-tracks being shown in FIG. 1, the upper channel-track being designated 11 and the lower channel-track being designated 13. The system also includes one or more implement holders, two exemplary holders being illustrated in FIG. 1. One of the implement holders, generally designated 17, is a jar assembly comprising a bracket, generally designated 19, and a jar, generally designated 21, removably mounted on the bracket for holding items for storage. The bracket 19 has a track-engaging element 25 which may be slidably engaged with the upper channel-track 11 so that it can be moved to a selected position on the rail 3, as will be described in detail hereinafter. The second implement holder, generally designated 31, is funnel-shaped, as described in my U.S. Pat. No. 6,305,557, and is attached to the rail 3 in a manner also to be described.

In the embodiment of FIGS. 1 and 2, the elongate rail panel 9 of the rail 3 is relatively thin (e.g., 0.1 in. thick), flat and generally rectangular. The rail panel 9 has a front face facing away from the mounting surface and a back face facing toward the mounting surface. The rail panel 9 also has an upper edge margin terminating in an upper edge 37 extending lengthwise of the rail panel, a lower edge margin terminating in a lower edge 39 extending lengthwise of the rail panel, and opposite (left and right) end edges 41, 43. Other panel shapes are possible. The rail panel 9 has a plurality of fastener holes 45 in it for receiving fasteners 47 to fasten the holders 17, 31 in selected positions.

Figure 2A:
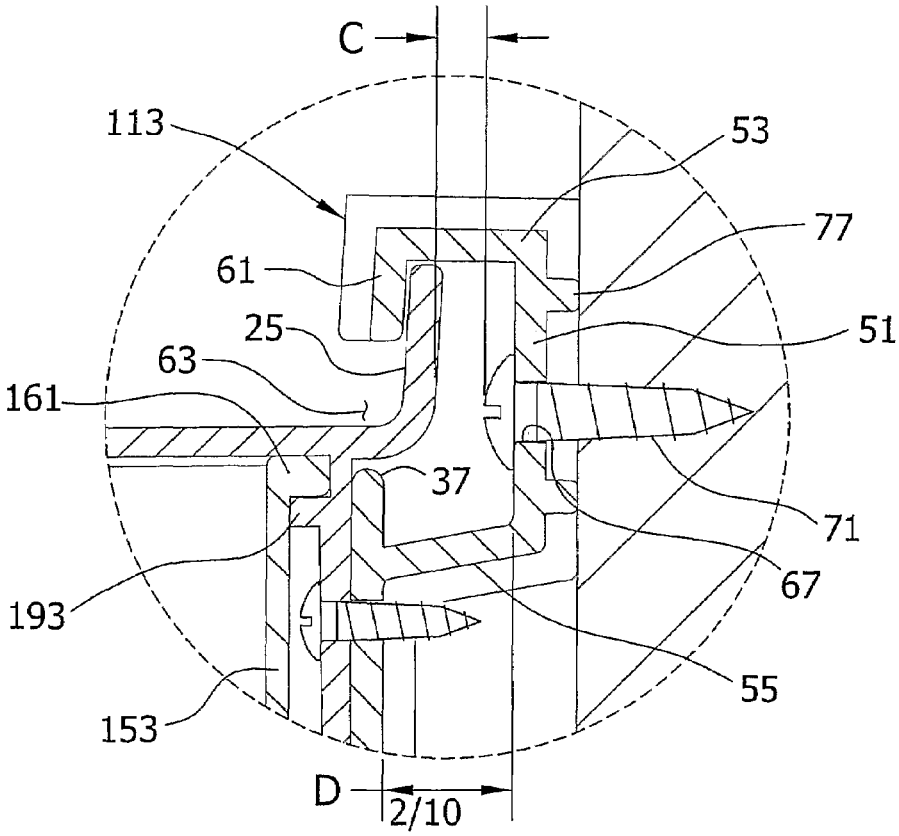
FIG. 2*a* is an enlarged view of a portion of FIG. 2 showing coupling of the jar assembly and the rail.

Referring to FIGS. 2 and 2A, the upper channel-track 11 of the exemplary embodiment is disposed on the back face of the rail panel 9. The channel-track 11 comprises a bottom wall 51 adapted to be positioned generally adjacent the mounting surface 5, and a pair of spaced-apart side walls, one hereinafter being referred to as an upper side wall 53 and the other as a lower side wall 55. In the illustrated exemplary embodiment, the lower side wall 55 is connected to the upper edge margin of the rail panel 9 at a location below the upper edge 37 of the rail panel, and the upper side wall 53 is spaced above the upper edge 37 of the rail panel. The upper side wall 53 has an inturned lip 61 generally opposing the upper edge 37 of the rail panel to define an upper slot 63 at the front side of the upper channel-track 11 extending the full length of the channel-track. The bottom wall 55 of the channel-track 11 has a plurality of fastener holes 67 (FIG. 2A) spaced at intervals (preferably but not necessarily regular intervals such as every ½ in.) along the channel-track for receiving one or more rail fasteners 71 to secure the rail to the mounting surface. These fasteners 71 may be common screws, for example, each having a head and a threaded shank extending from the head. Advantageously, a depth D (FIG. 2A) of the channel from the plane of the slot 63 to the bottom wall 51 of the channel-track 11 is such that when the rail fasteners 71 are in place securing the rail to the mounting surface 5, there is sufficient clearance C (FIG. 2A) to permit implement holders (e.g., 17) having track-engaging elements (e.g., 25) to be slidably moved to their desired positions without interference with the heads of the fasteners. This clearance is preferably at least ⅛ in., but this dimension may vary. The back surface of the bottom wall 51 of the channel-track 11 has a pair of parallel ribs 77 thereon which contact the mounting surface 5 when the rail is secured thereto (see FIG. 2). The fastener holes 67 are located between these ribs 77 in the embodiment shown in the drawings.

The lower channel-track 13 is similar to the upper-channel track 11, also being disposed on the back face of the rail panel 9, as shown in FIGS. 1 and 2. The lower channel-track 13 has a bottom wall 81 with parallel ribs 82 (FIG. 2) which contact the mounting surface 5 and parallel upper and lower side walls 83, 85. The lower side wall 85 has an inturned lip 89 which opposes the lower edge 39 of the rail panel to define a lower slot 91 which runs the length of the lower channel-track 13. Similar to the upper channel-track 11, the bottom wall 81 of the lower channel-track has fastener openings 95 spaced at intervals along the wall, and sufficient clearance is provided to enable passage of a track-engaging element of a holder past a fastener 71 in one of the openings 95 as the holder is moved along the lower channel-track 13.

Figure 3:
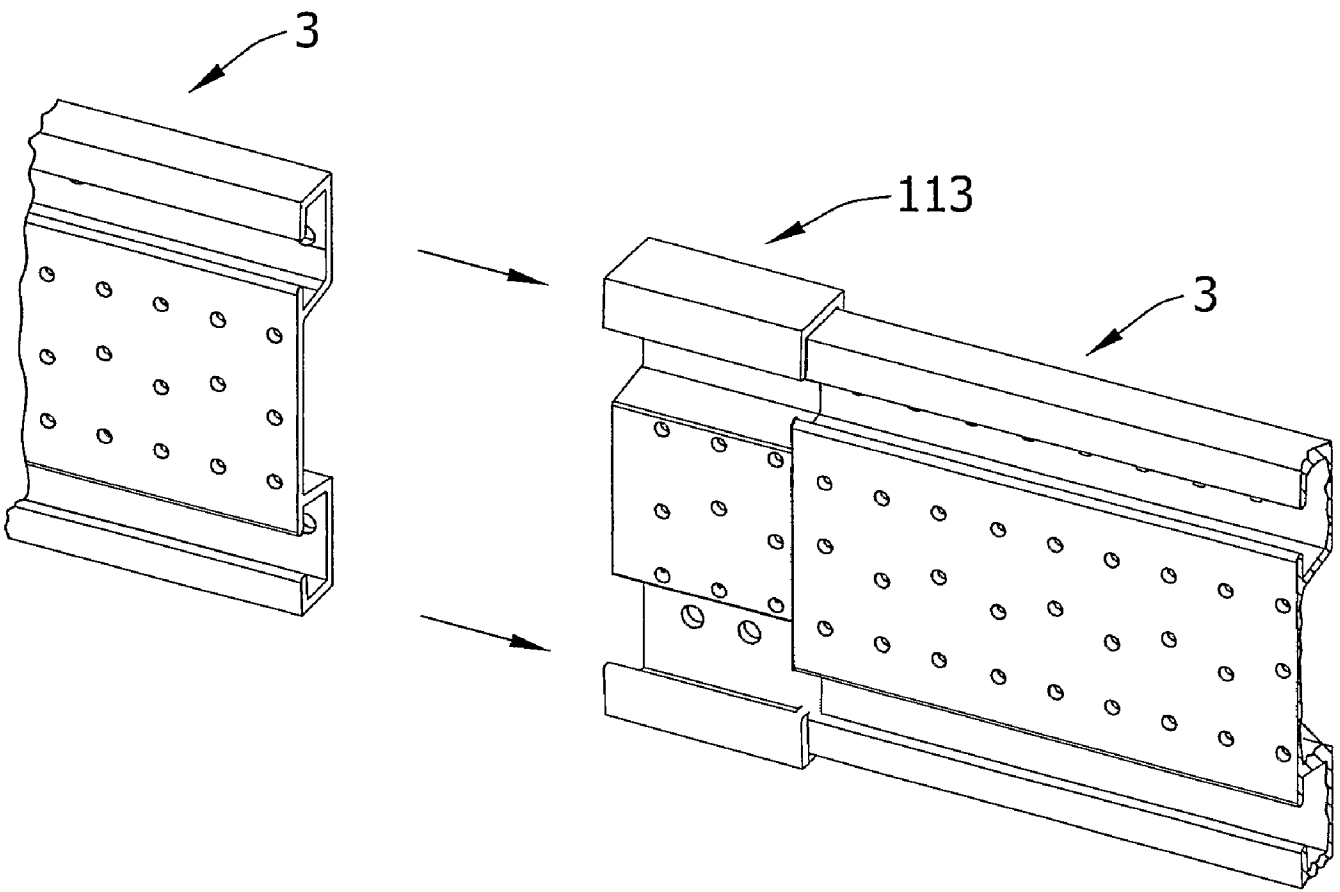
FIG. 3 is a perspective of a connection between two rails.
Figure 3A:
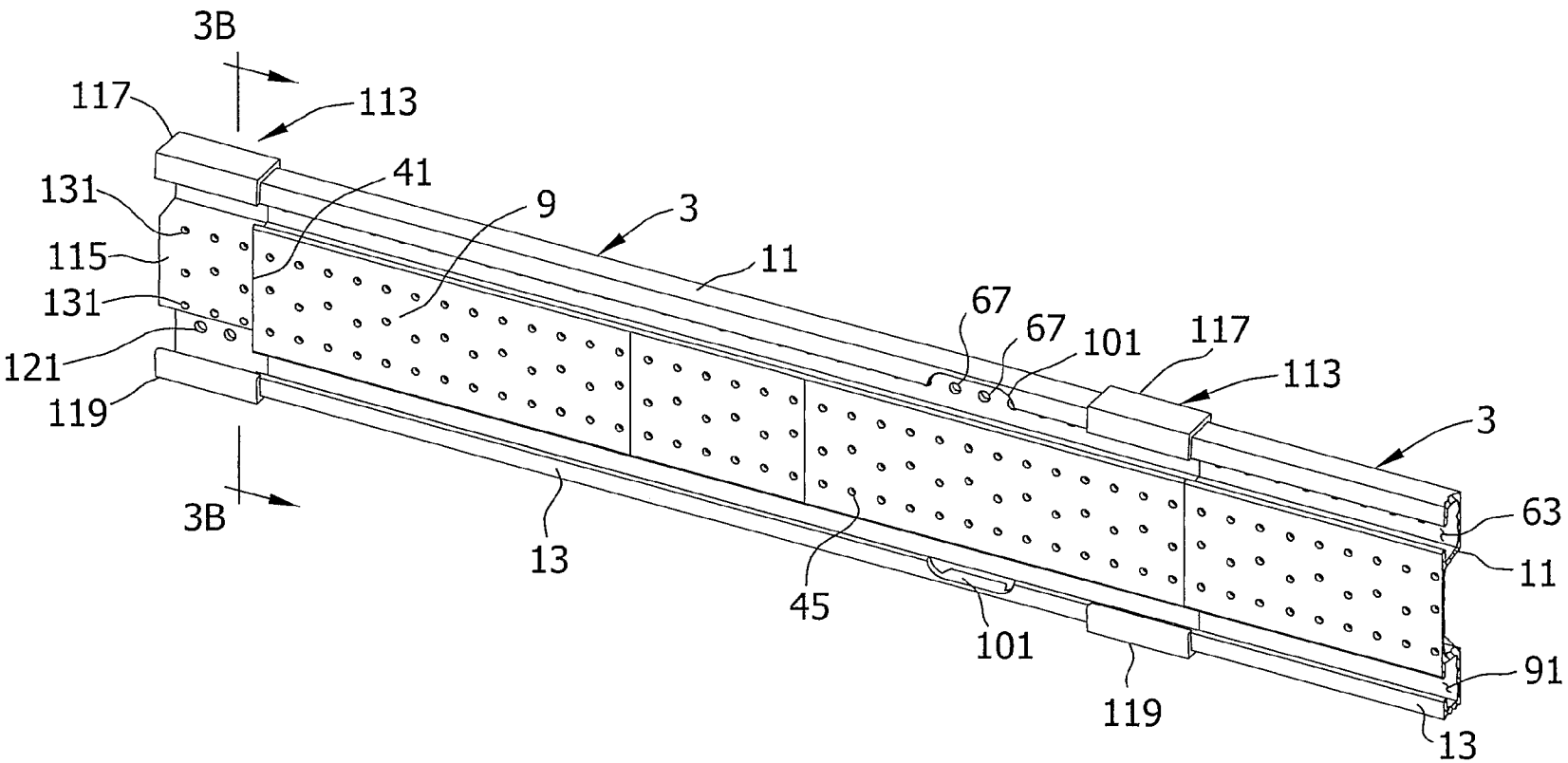
FIG. 3A is a perspective of the connected rails of FIG. 3.

As best illustrated in FIGS. 1 and 3, the upper and lower slots 63, 91 in respective channel-tracks 9, 11 are enlarged to form one or more pairs of vertically aligned notches 101 at certain locations between the ends of the rail. (Only one such pair of notches 101 is shown in FIG. 3, but others may be provided.) Each notch 101 permits entry of a track-engaging element (e.g., 25) of an implement holder (e.g., 17) through a respective slot 63, 91 and into a respective channel-track 11, 13, thereby permitting the holder to be slidably moved to a selected position on the rail 3. Alternatively, the track-engaging element may be inserted into the channel-track from an end of the rail, assuming the end is accessible and not blocked by a connection to another rail or in some other way.

The rail panel 9 of the rail 3 and the upper and lower channel-tracks 11, 13 may be integrally formed (e.g., molded) as a single piece or formed as separate pieces and then connected in suitable fashion. The various components may be of plastic or other suitable material.

Figure 3B:
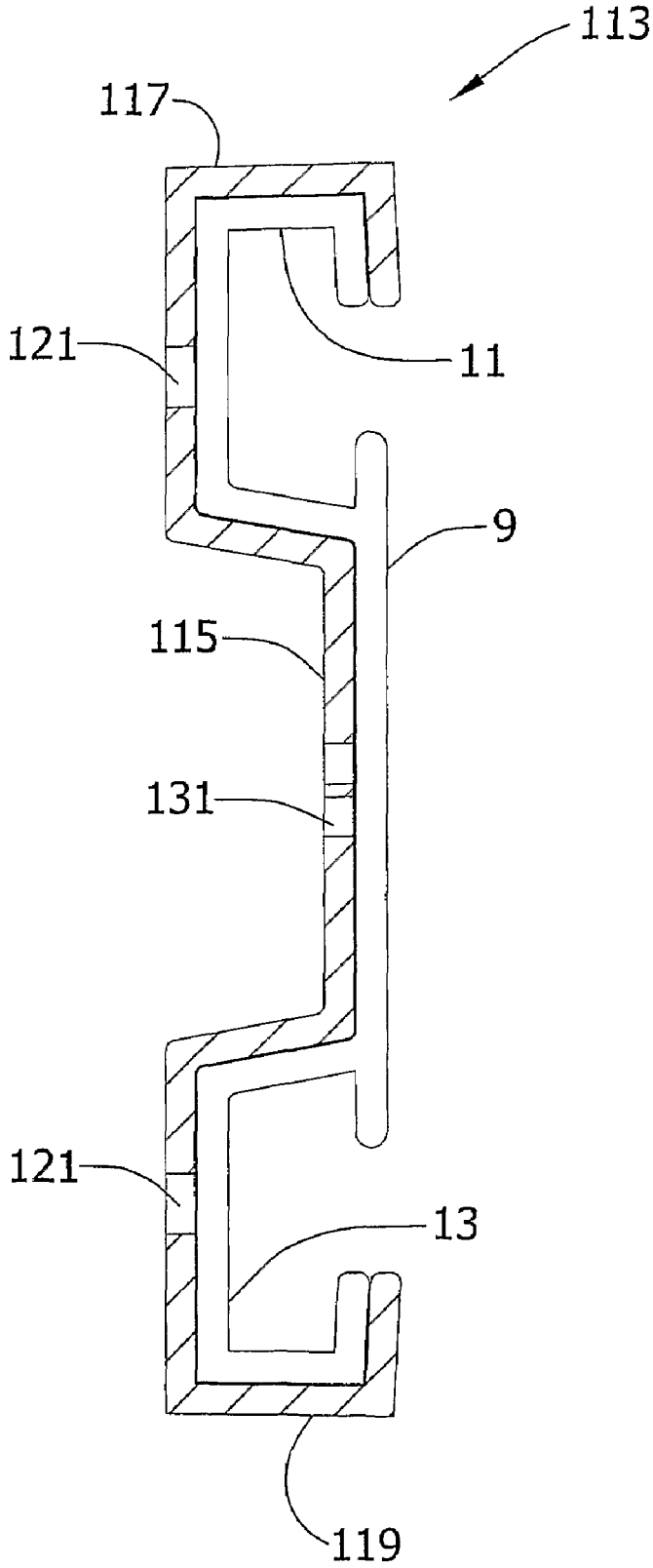
FIG. 3B is a vertical section of the rail and associated connection along line 3B-3B of FIG. 3A.

As illustrated in FIGS. 3-3B, multiple rails 3 may be connected together end to end to increase the capacity of the system (e.g., the number of holders used). To facilitate such connection, each rail 3 includes a connection section 113 at one end (the left end as viewed in FIG. 3) configured for an overlapping fit with the opposite (right) end of an adjacent rail. In the illustrated embodiment, the connection section 113 of the rail comprises a connection panel 115 offset in a rearward direction relative to the rail panel 9, and upper and lower connection channel-tracks 117, 119 which are enlarged in transverse cross section relative to the rail channel-tracks 11, 13. The arrangement is such that the right end of each rail 3 is configured for an overlapping (e.g., telescoping) fit with the connection section 113 at the left end of an adjacent rail. When the rails of this embodiment are thus connected, the rail panels 9 of the two rails 3 are generally co-planar and closely adjacent or butted up against one another, and the upper and lower rail channel-tracks 9, 13 of the two rails are closed adjacent or butted up against one another to provide a substantially uninterrupted or seamless continuation of the rail panels, rail channel-tracks and slots from one rail to the next (see FIG. 3). The rails are held in fixed position relative to one another after they are connected by fastening each rail to the mounting surface 5 using the aforementioned rail fasteners 71. The overlapping telescoping connection between the rails 3 may also be accompanied by a friction-fit between the parts. The connection panel 115 of the connection section 113 has fastener holes 131 in it for securing an implement holder at this location, if desired. The bottom walls of the connection channel-tracks 117, 119 also have fastener holes 121 for receiving fasteners (e.g., 71) to secure the rail 3 to the mounting surface 5.

Figure 6:
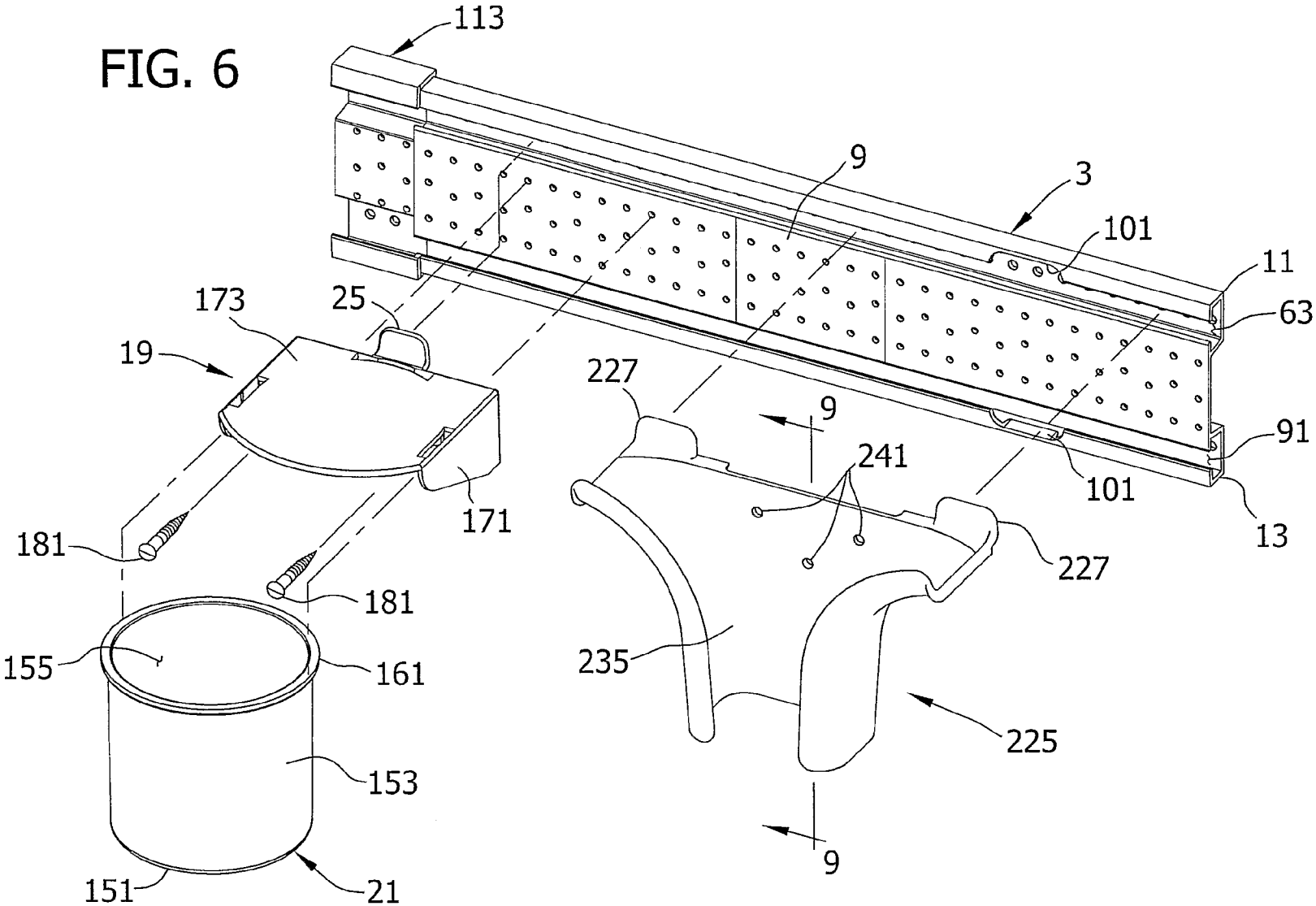
FIG. 6 is an exploded view various components of the system.

As shown in FIGS. 2 and 6, the jar 21 of the jar assembly 17 has a bottom 151, a cylindric side wall 153 defining an open mouth 155 at the upper end of the jar, and a circular peripheral flange structure 161 projecting out from the side wall of the jar at its mouth. The jar may have other shapes (e.g., rectangular) without departing from the scope of this invention. Further, the flange structure 161 may be formed as one continuous flange or one or more flange segments. In one embodiment, the jar 21 is made of a resilient material (e.g., resilient molded plastic), but it may also be rigid. The jar may have any suitable capacity.

The bracket 19 of the jar assembly 17 shown in FIGS. 2 and 4-6 includes a pair of spaced-apart, generally parallel side walls 171, a top wall 173 spanning the side walls, and a back wall 175. The track-engaging element 25 comprises a J-shaped member or hook extending up from the top wall 173 adjacent its back edge. In other embodiments, the track-engaging element 25 may have other shapes and may be at other locations on the bracket 19. The entire bracket 19, including the track-engaging element 25, may be a one-piece molded unit of a suitable plastic material, for example. To mount the bracket 19 on the rail, the track-engaging element 25 may be inserted into and through the enlarged notch 101 in the upper slot 63 and then slidably moved along the channel-track 11 to a selected position. The bracket 19 may be secured in that position by one or more fasteners (e.g., screws 181 in FIG. 6) extending through selected one or more mounting openings 183 in the back wall 175 of the bracket into the rail panel. The screws 181 preferably have a length such that they do not screw into the mounting surface 5. In the embodiment shown in FIG. 5, the mounting openings 183 in the back wall 175 of the bracket 19 are in the form of slots extending up from the lower edge of the back wall. This configuration allows for some range of adjustment of the elevation of the bracket relative to the rail 3, as needed or desired.

Figure 4:
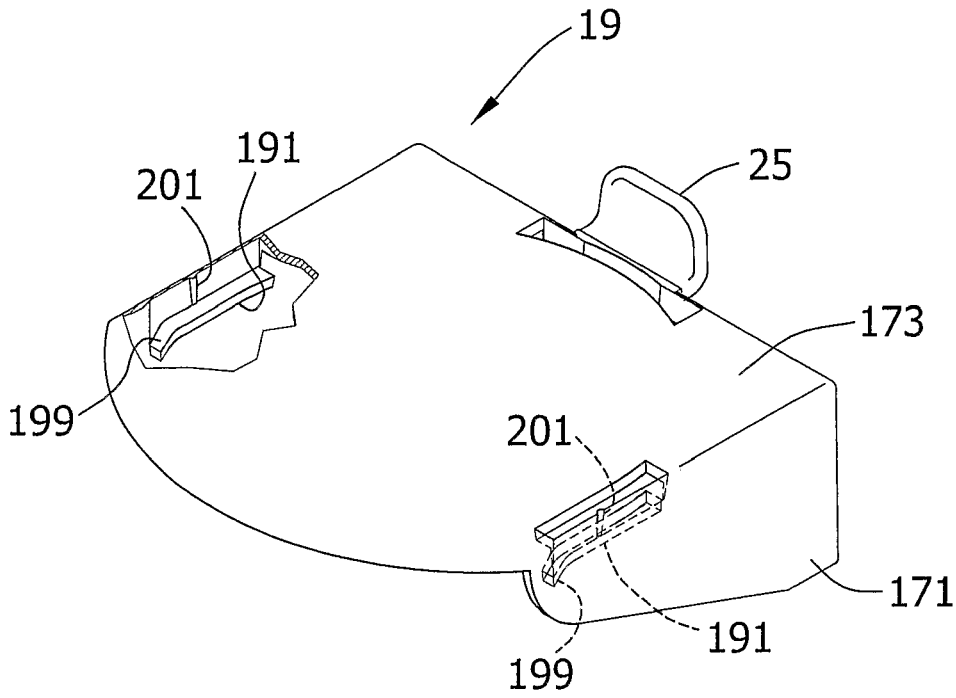
FIG. 4 is a perspective of a bracket of the jar assembly of FIG. 1.
Figure 5:
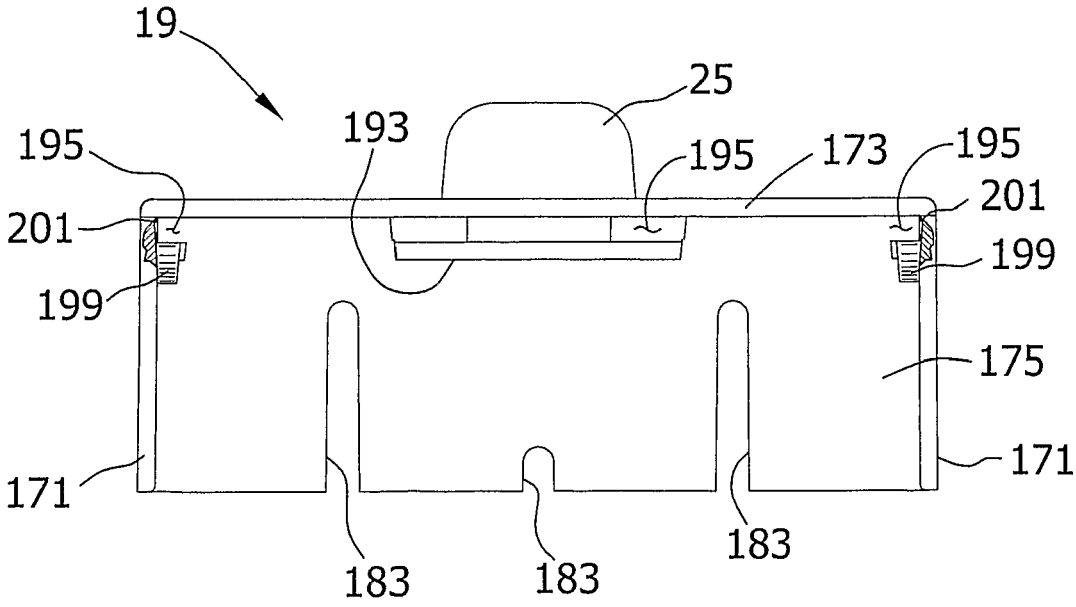
FIG. 5 is front elevation of the bracket of FIG. 4.

As shown best in FIGS. 4 and 5, the side walls 171 of the bracket 19 are formed with opposing jar supports 191, and the back wall 175 of the bracket is formed with a jar support 193. All of these supports 191, 193 are spaced below the top wall 173 of the bracket and define a slideway 195 for slidably receiving the jar 21. In the illustrated embodiment (FIGS. 4 and 5), the jar supports 191 comprise ledges projecting from respective back and side walls 171, 175 for supporting portions of the flange structure 161 on the jar. The flange structure 161 is adapted to rest on the jar supports when the jar is slidably moved into the slideway 195 to a storage position below the top wall of the bracket, which serves as a cover for the jar (FIGS. 1 and 2). The front portion of each side wall support 191 is sloped to provide a lead-in ramp 199 to facilitate movement of the jar into the slideway 195.

Figure 7:
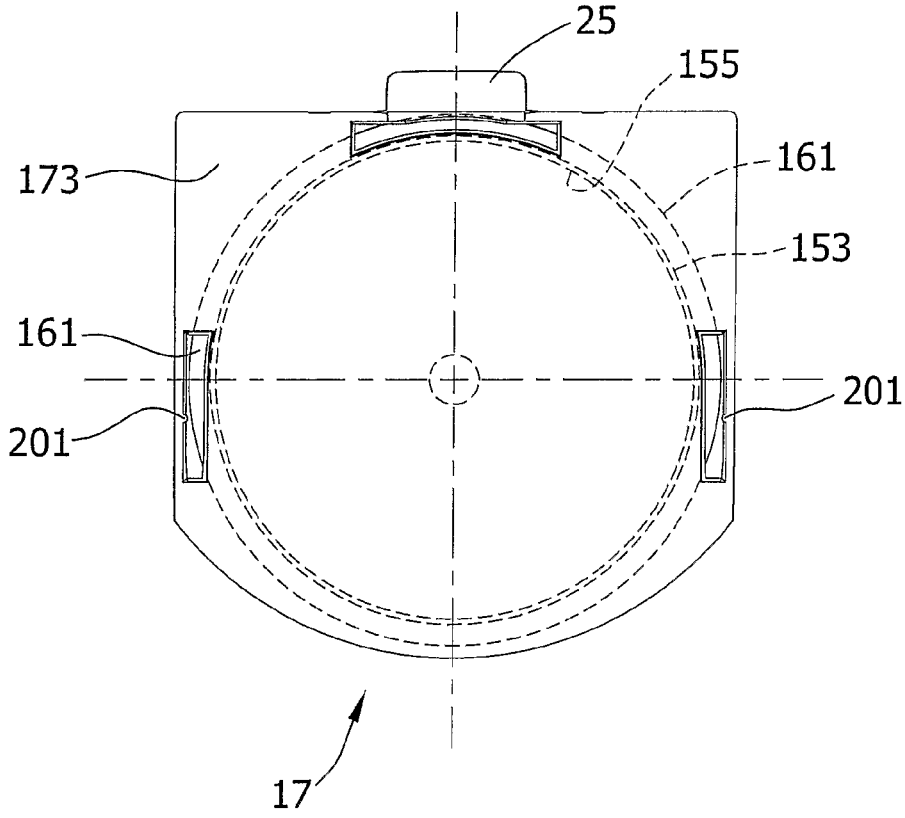
FIG. 7 is a top plan view of the jar assembly of FIG. 1.
Figure 7A:
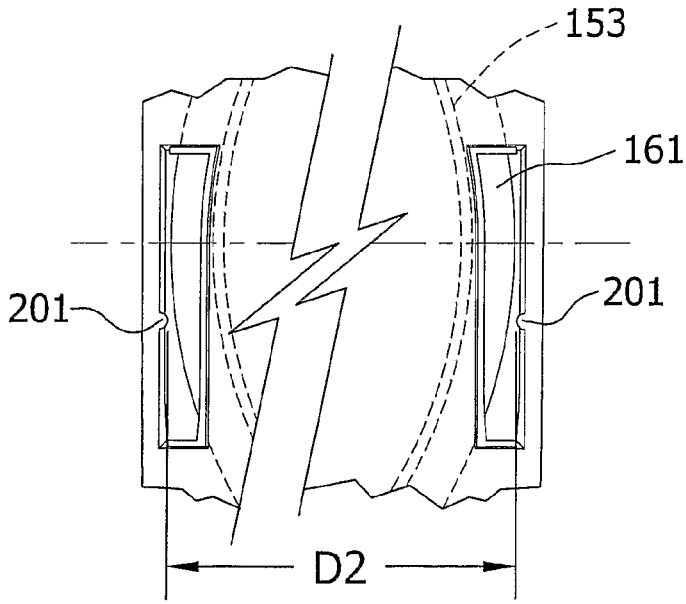
FIG. 7A is an enlarged portion of FIG. 7.

The bracket 19 also includes a detent mechanism for releasably holding the jar 21 in its storage position below the top wall 173 of the bracket. In the embodiment shown in FIGS. 4-7A, this detent mechanism comprises a pair of detents 201 in the form of opposing bosses or projections on the side walls 171 of the bracket 19 above the jar supports 191. These detents define a distance D2 (FIG. 7A) across the slideway 195 less than an outside diameter of the jar 21 (e.g., less than the diameter of the peripheral flange structure 161). The jar 21 and/or the detents 201 are resiliently deformable to permit the jar to be slidably pushed (preferably but not necessarily with a twist) into the slideway 195 past the detent mechanism (i.e., in a direction toward the back wall 175 of the bracket 19) to an over-center position (FIG. 7) in which the maximum diameter of the jar, in this case the flange structure 161 of the jar, is located to the rear of the detents 201, thereby allowing the detents to snap back toward their original position for releasably holding the jar against withdrawal from the slideway. To remove the jar, it is simply pulled in a forward direction (preferably but not necessarily with a twist) with sufficient force to resiliently deform the detents 201 and/or the jar 21 to allow the jar to move forward past the detents and out of the slideway 195, either partially or entirely.

In other embodiments (not shown), multiple jars of different capacities may be used in conjunction with the same bracket 19, or multiple brackets 19 may be provided each having its own dedicated jar of appropriate size. Any number of jar assemblies (from one to two or more) can be mounted on the rail(s) 3.

In still other embodiments, the bracket 19 may be made without a track-engaging element 25. In this case, the bracket is simply secured to the rail 3 by one or more fasteners 181 extending through suitable openings (e.g., 183) in the back wall of the bracket into selected holes 45 in the rail panel 9.

Figure 8:
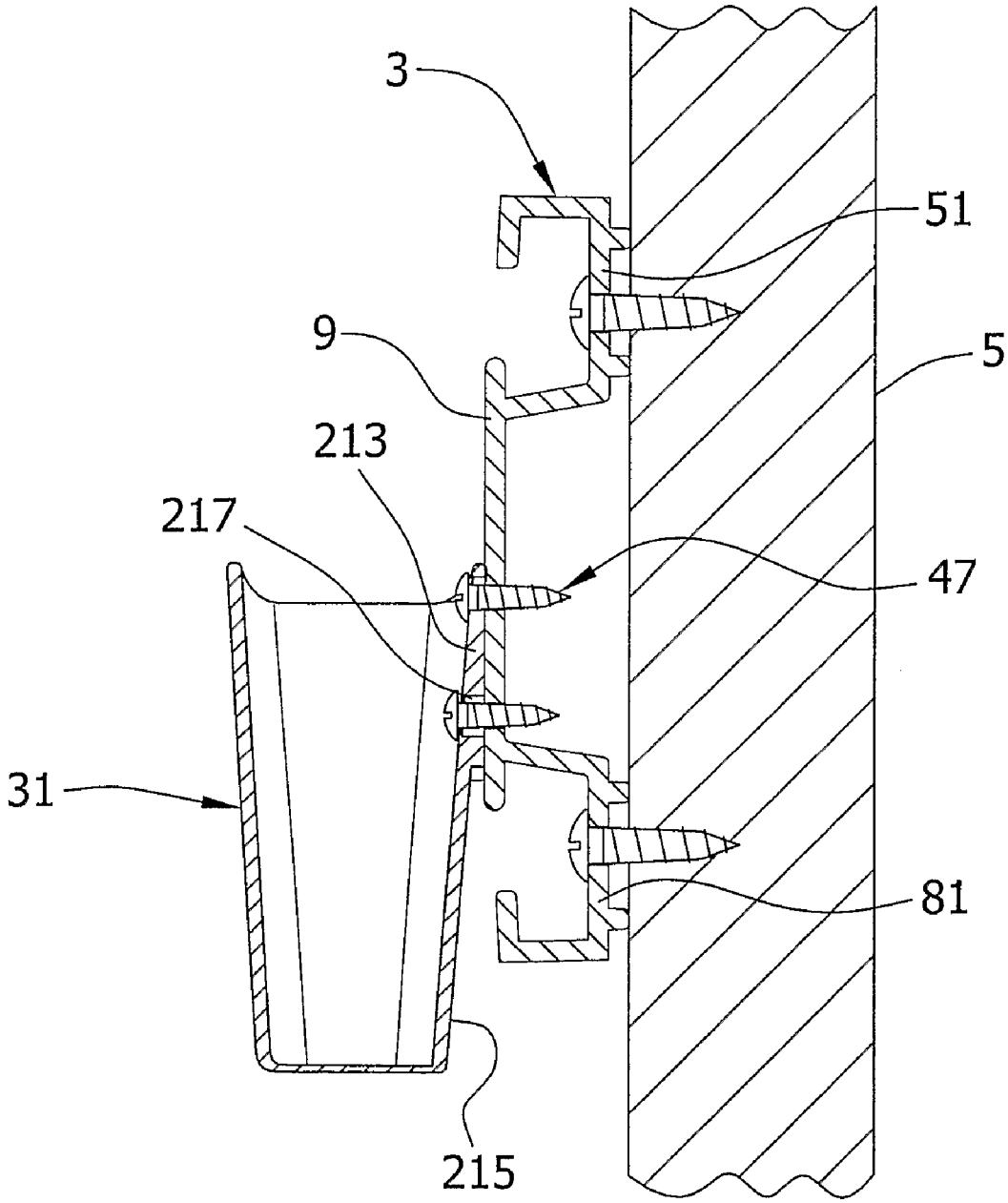
FIG. 8 is a vertical section of the funnel-shaped older and rail along line 8-8 of FIG. 1.

Referring to FIGS. 1 and 8, the funnel-shaped holder 31 is of relatively small size but otherwise has the shape and functional characteristics described in my aforementioned patent. The holder is formed with a standoff 213 on the back wall 215 of the holder which is adapted to lie flat against the rail panel 9 for stability. One or more fasteners (e.g., screws 47) may be used to secure the holder 31 to the rail panel 9 in any desired position along the rail, with each fastener extending through holes 217 in the back wall 215 and standoff 213 of the holder into a selected fastener hole 45 in the rail panel 9. The holder fasteners 47 are preferably dimensioned such that when threaded in place, they do not extend rearward beyond the bottom wall 51 of the upper channel-track 11 or the bottom wall 81 of the lower channel-track 13, so that they do not penetrate the rail mounting surface 5. The holder 31 may be a one-piece molded part.

Figure 9:
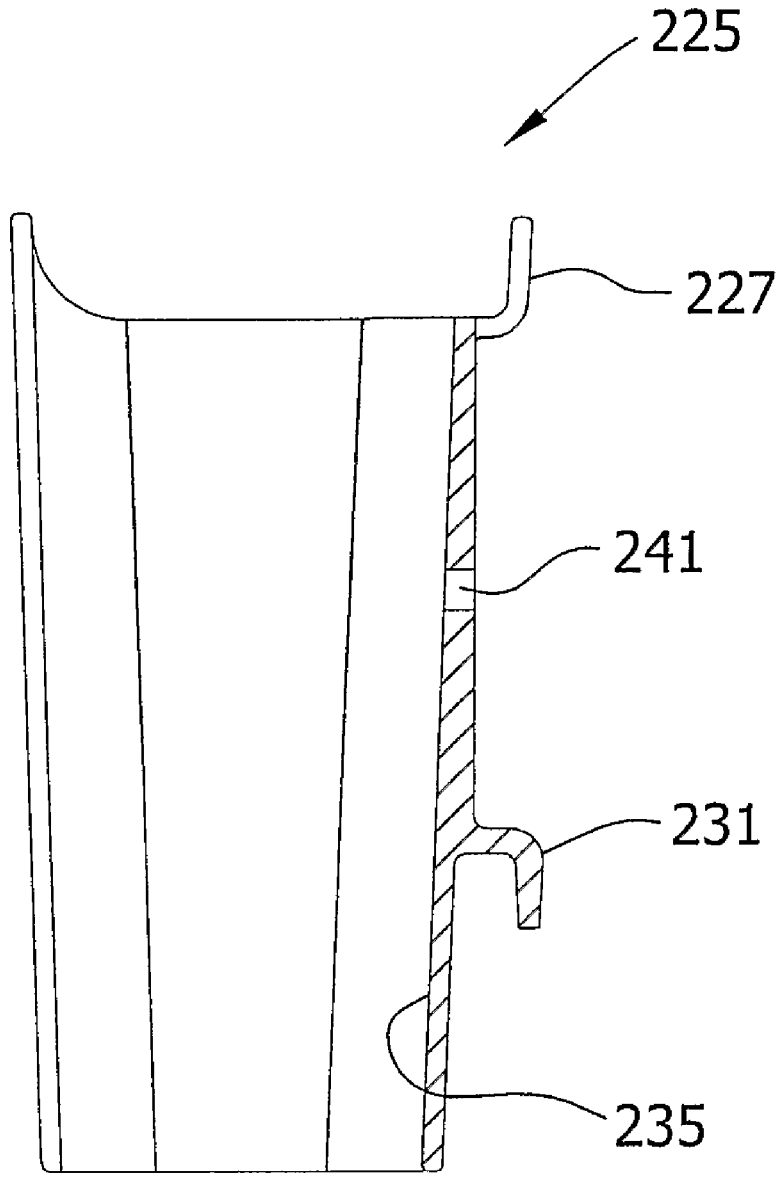
FIG. 9 is a vertical section of the larger funnel-shaped holder along line 9-9 of FIG. 6

The rail 3 is also suited for mounting a larger funnel-shaped holder, generally designated 225 in FIGS. 6 and 9. This holder 225 has a pair of upper track-engaging elements 227 slidable in the upper channel-track 11 and a lower track-engaging element 231 (FIG. 9) slidable in the lower channel-track 13. In one embodiment, the track-engaging elements 227, 231 are J-shaped members or hooks integrally formed with the back wall 235 of the holder, but the track-engaging elements may have other shapes and locations. Reference may be made to my aforementioned U.S. Pat. No. 6,305,557 for further details regarding the design and operation of this type of holder. When the holder 225 is mounted on the rail 3, the track-engaging elements 227, 231 extend forward through respective slots 63, 91. The holder 225 may be slidably moved into a desired position along the rail 3, there being sufficient clearance in the channel-tracks 11, 13 between the rail fasteners 71 and the track-engaging elements 227, 231 as discussed above. Once in place, the holder 225 may be secured to the rail panel 3 by inserting fasteners (not shown) through one or more fastener holes 241 in the back wall 235 of the holder and then threading them into one or more selected aligned fastener holes 45 in the rail panel 9. The holder fasteners are preferably dimensioned such that when threaded in place, they do not extend rearward beyond the bottom wall 51 of the upper channel-track 11 or the bottom wall 81 of the lower channel-track 13, so that they do not penetrate the rail mounting surface 5.

A second embodiment 300 of a system of the present invention for holding one or more implements is shown in FIGS. 10-21. This system is similar in many respects to the system described above but with the additional advantage of being more compact, requiring less material, and providing greater flexibility of use. The system includes a rail 302 adapted to be mounted on a generally vertical mounting surface 304, and an implement holder 306 having a snap-lock fastener 308 for snap-fastening engagement with the rail to releasably fasten the holder at a fastened position on the rail. This snap-fastening feature provides an advantage in that the holder may be readily mounted at any desired position along the rail. Further, the inter-connection provides a generally tight, friction fit so that the holder will not inadvertently slide along the rail. When the holder is at its fastened position, the holder 306 and rail 302 exert relative frictional forces sufficient to prevent unintentional relative movement of the holder along the rail.

Figure 10:
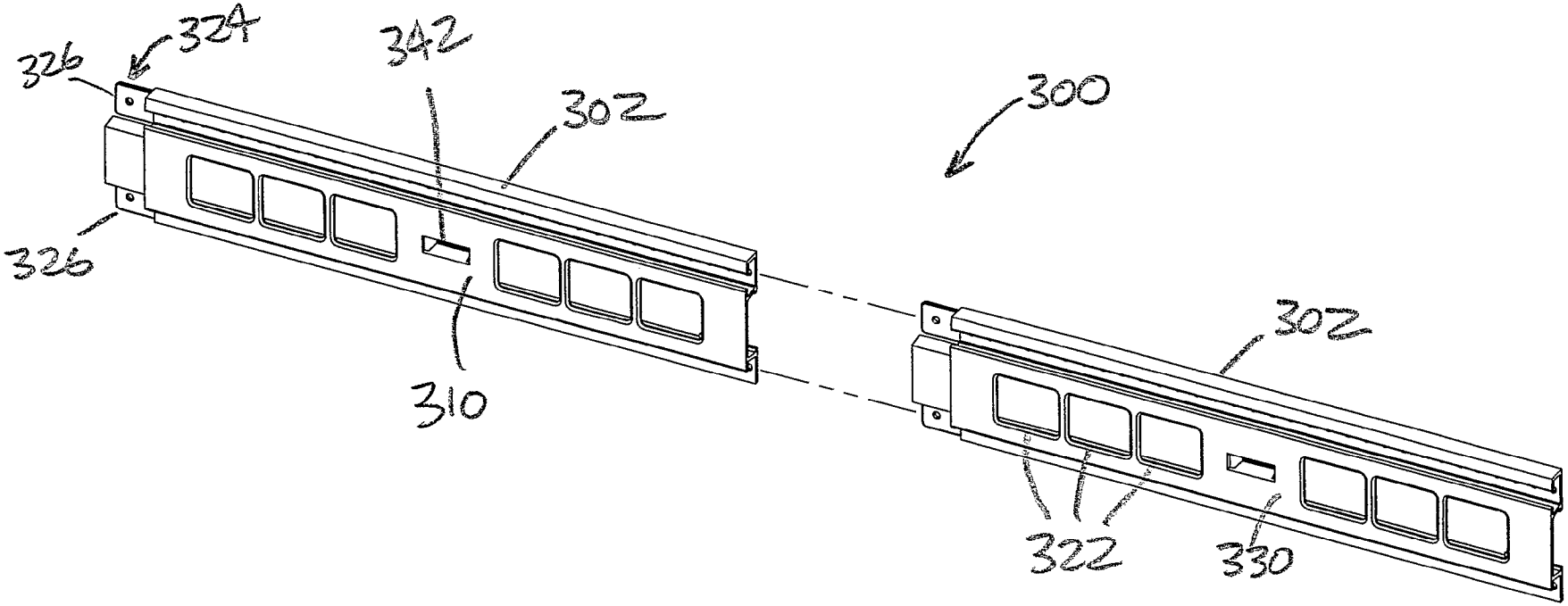
FIG. 10 is an exploded front perspective of two rails of a second embodiment which are joined end-to-end.
Figure 11:
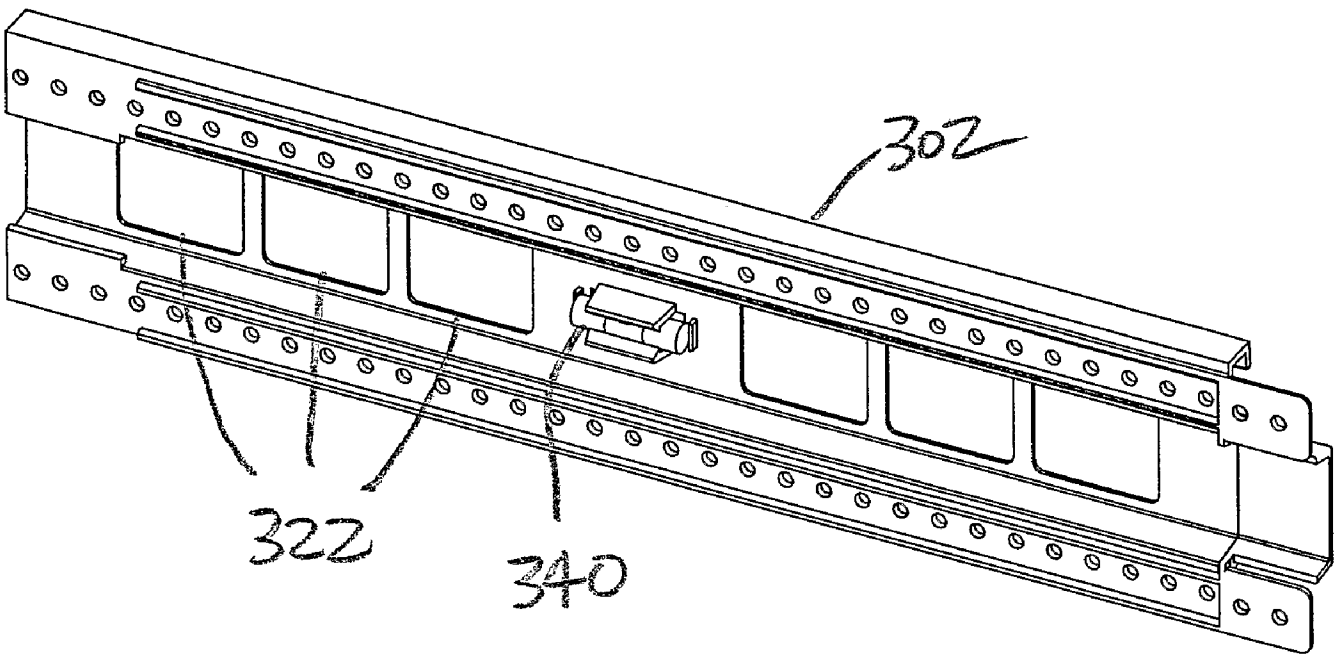
FIG. 11 is a rear perspective of one of the rails of FIG. 10.
Figure 12:
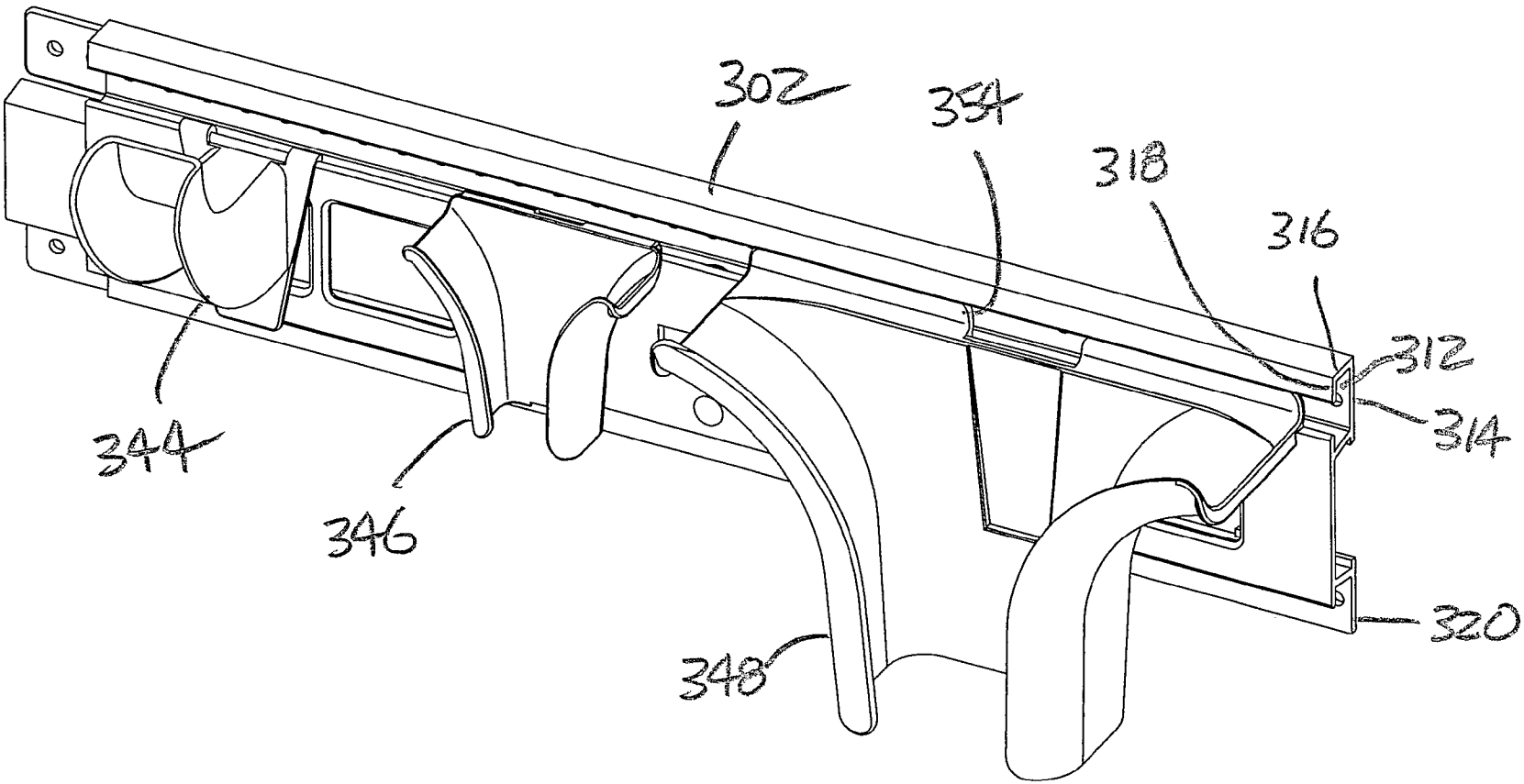
FIG. 12 is a front perspective of several implement holders fastened to one of the rails of FIG. 10.
Figure 13:
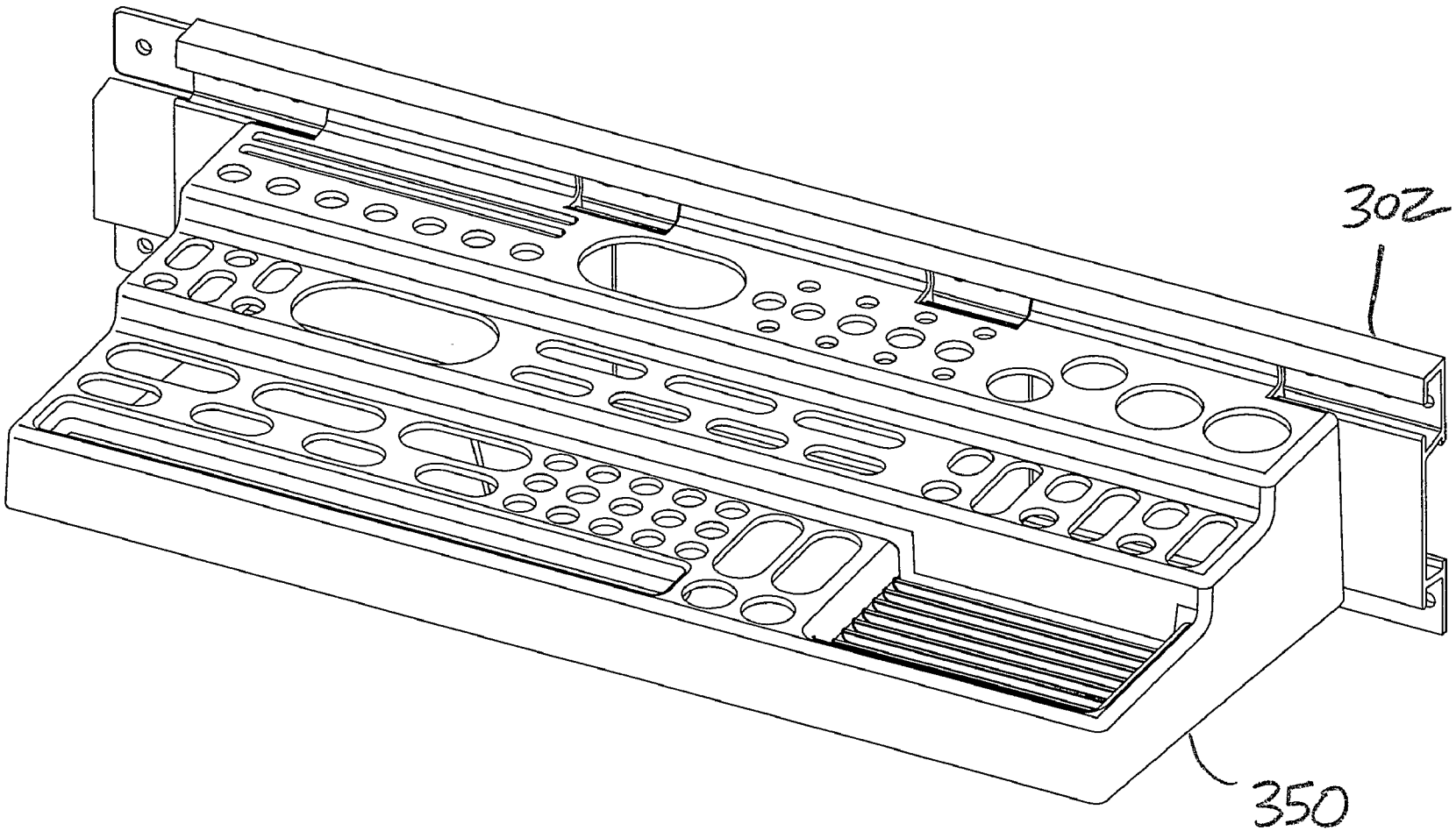
FIG. 13 is a front perspective of an implement holder comprising a tool rack which is fastened to the rail.

Referring to FIGS. 10 and 11, the rail 302 of this embodiment comprises a front panel 310, an upper channel-track 312 which includes a back wall 314, an upper side wall 316, an inturned lip 318, and a lower mounting structure having a back wall 320 with no side wall or lip. One or more window openings 322 may be placed in the front panel 310, as shown in the illustrated embodiment, to reduce the mass of the rail. Preferably, the aggregate window openings represent a reduction of at least 20% of the rail mass.

The rail 302 is configured to have a telescoping end-to-end fit with a second rail. In one embodiment (FIGS. 10 and 11), each rail 302 has a connecting region 324 at one end with surfaces which are recessed relative to the other portions of the rail, such that the connecting region telescopes into the opposite end of an adjacent rail. Upper and lower tabs 326 comprise extensions of the back walls 314, 320 of the upper channel-track and lower mounting structure, respectively. The resulting joint is stable, with smoothly adjacent (i.e., flush) surfaces on front and back sides of the rail.

The front panel 310 of each rail comprises a mount for mounting implement holders on the rail. A front face 330 of the panel faces away from the vertical mounting surface 304, and a back face 332 of the panel faces toward the mounting surface. When two rails 302 are interconnected, the front faces 330 of the front panels of adjacent rails are substantially coplanar. The mount (e.g., panel 310) has first and second vertically spaced edges 334, 336. In the embodiment shown in the drawings, the edges are generally parallel upper and lower edges spaced apart to define a height of the front face of the mount.

In one embodiment, a level 340 is mounted on the rail 302 for accurately positioning the rail at a level orientation on the mounting surface. The level 340 is mounted on the back face 332 of the mount by suitable means (e.g., a clip), and it is visible from the front of the rail through a viewing window 342 in the front panel 310.

Figure 14:
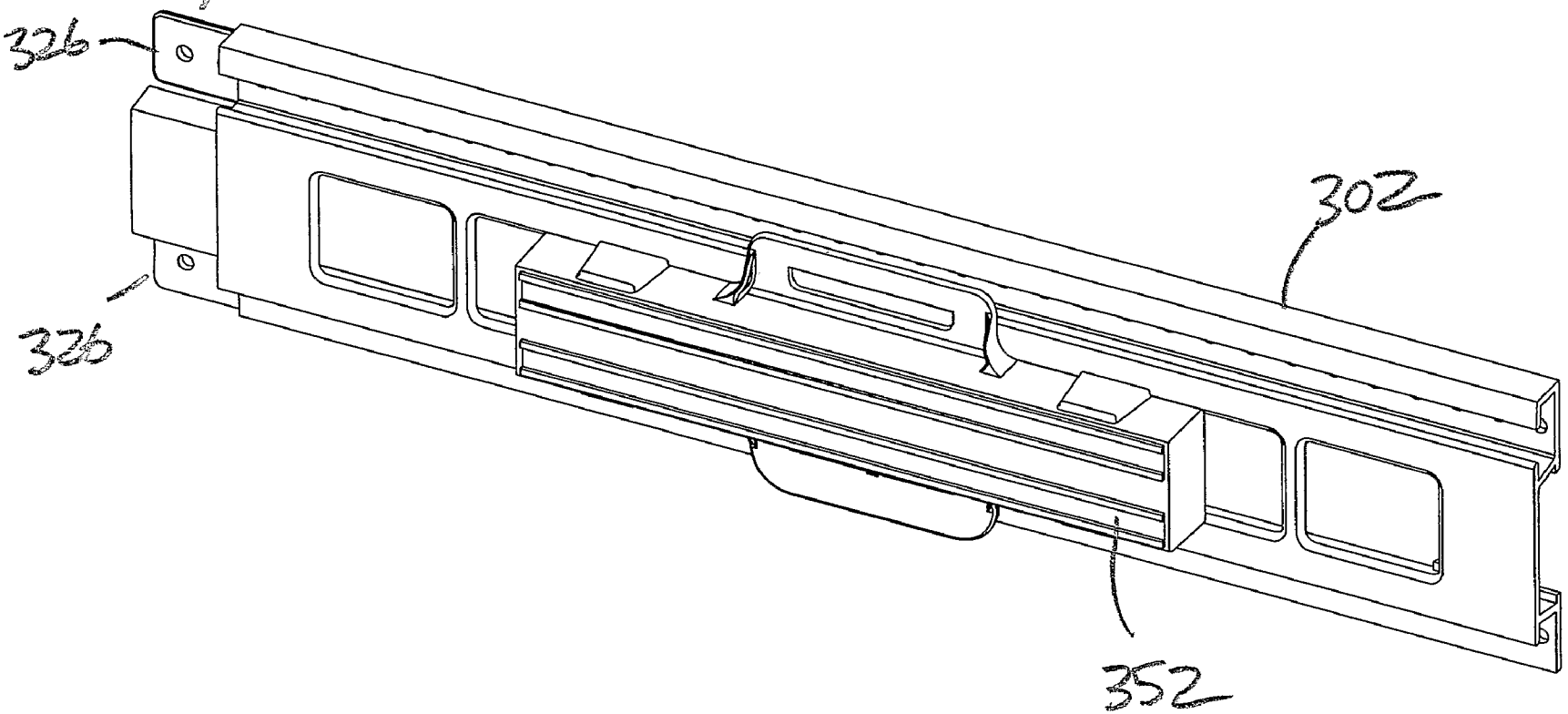
FIG. 14 is a front perspective of an implement holder comprising a magnet fastened to the rail.

The system is versatile and can mount a variety of types of holders for supporting objects of various configurations. In addition to a jar, the implement holder may comprise an upturned hook 344 (FIG. 12), a smaller funnel 346, a larger funnel 348 (FIG. 12), a tool rack 350 (FIG. 13), or a magnet 352 (FIG. 14). Other types, shapes, and sizes of accessories do not depart from the scope of this invention. Each of the holders may be configured for snap-fastening attachment to the rail 302 at any desired lateral location, or could be slid onto the rail from an end of the rail to the desired location. In the illustrated embodiment, the larger funnel 348 (FIG. 12) has upper tab extensions 354 which extend into the generally enclosed region of the upper channel-track 312 adjacent the inturned lip 318. That can improve the stability and strength, especially when supporting heavier implements.

Figure 15:
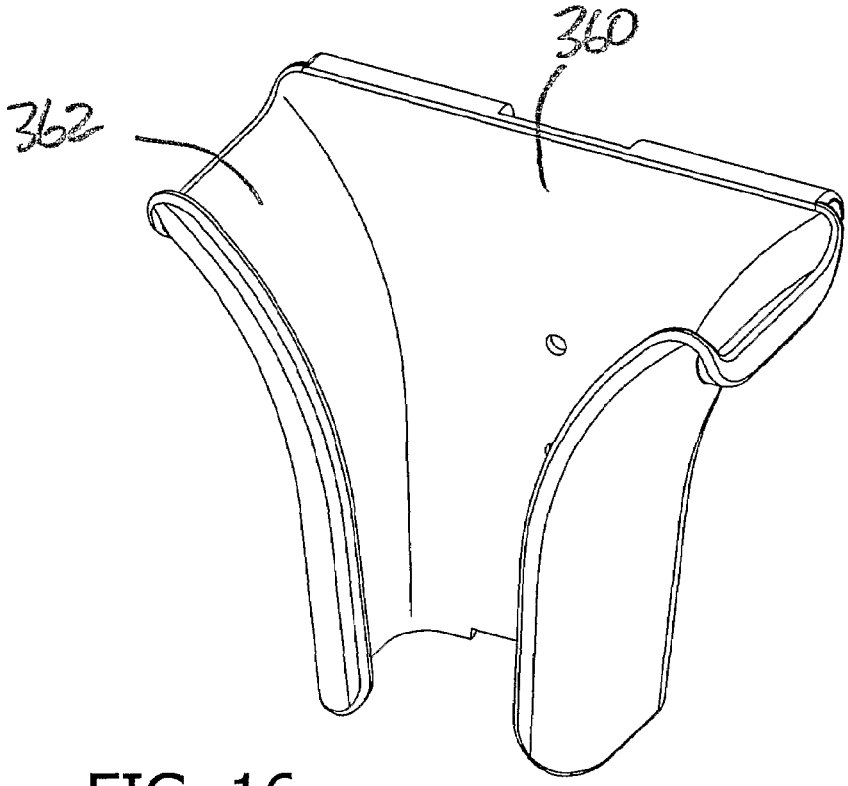
FIG. 15 is a front perspective of a funnel-shaped implement holder.
Figure 16:
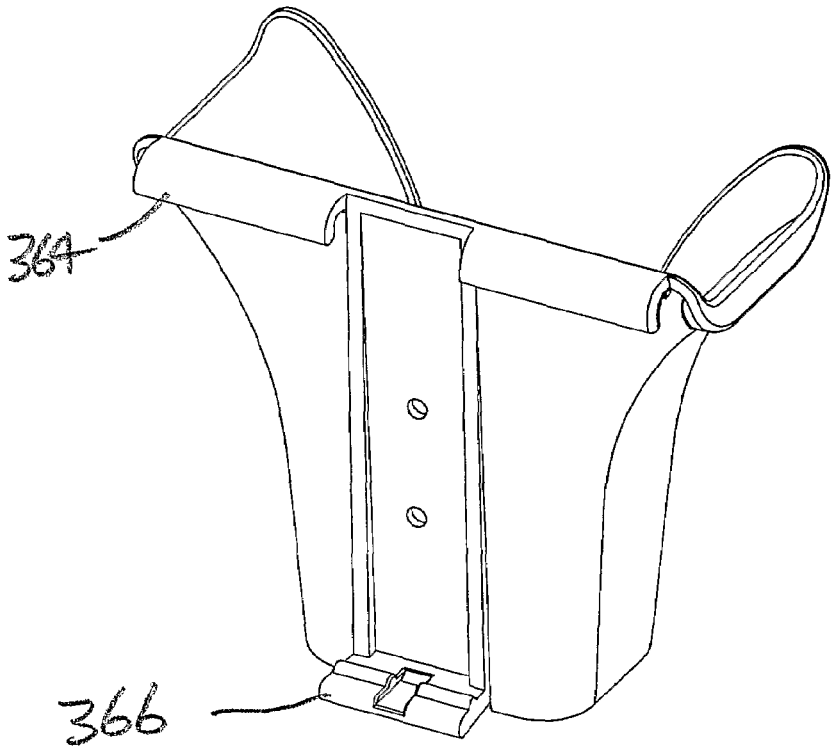
FIG. 16 is a rear perspective of the funnel-shaped implement holder of FIG. 15.
Figure 17A:
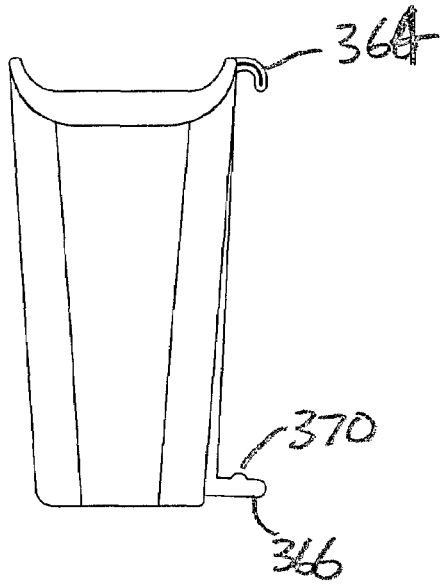
FIG. 17A is a side elevation of the funnel-shaped implement holder of FIG. 15.
Figure 17B:
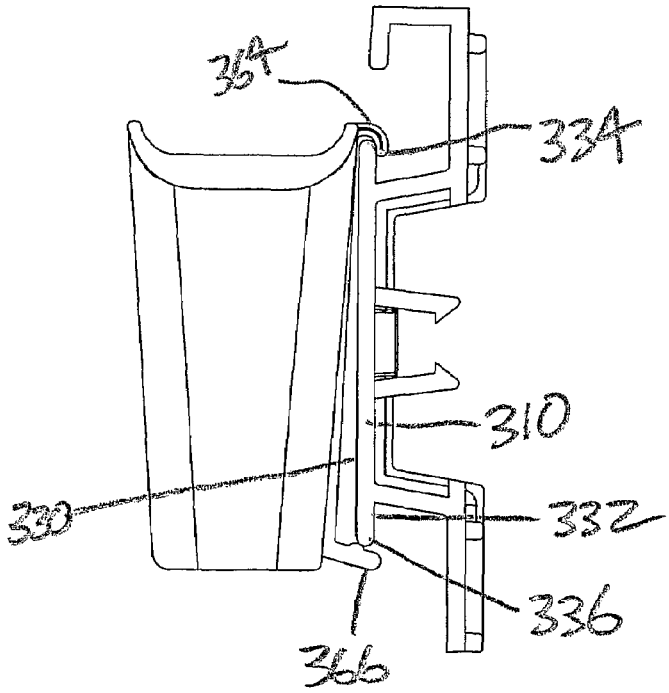
FIG. 17B is a side elevation of the holder of FIG. 15 during installation onto the rail.
Figure 17C:
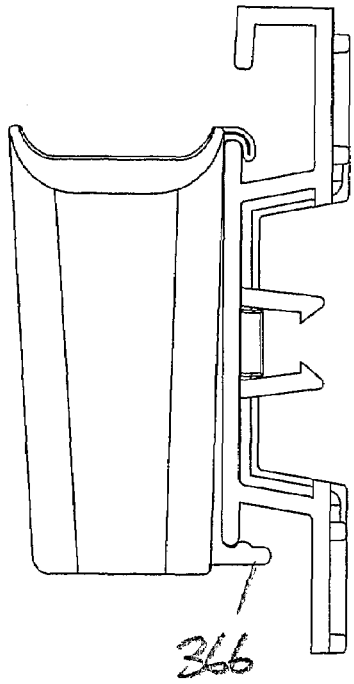
FIG. 17C is a view similar to FIG. 17B with the holder fully installed at a fastened position.

Referring to FIGS. 15-17, an embodiment of the smaller funnel-shaped holder 346 is shown. The holder is configured for snap-fastening attachment to a wall mount (e.g., the rail 302). The holder 346 has a funnel structure with an upper end that flares open upwardly and is relatively wide for receiving an implement, a lower end that is relatively narrow, a rear wall 360 with an inside surface and an outside surface, and opposite converging side walls 362 which define, in conjunction with said rear wall, a funnel-shaped recess for holding the implement in a stored position.

In the embodiment shown in the drawings, the funnel 346 has first and second fastening formations 364, 366 which each project rearward of the rear wall 360, as shown in FIG. 17A, for engagement with the mount. The second fastening formation 366 is positioned in spaced relation from the first fastening formation 364. The second fastening formation comprises a snap-lock fastening formation configured for releasable snap-fastening interconnection with the mount 310. It is understood that there may be a different number, shape, or arrangement of fastener means, in particular a different number or configuration of snap-lock fastening formation(s), without departing from the scope of this invention. In one embodiment, the funnel and fastening formations have a one-piece, molded body.

Further, although the formations herein are discussed with respect to the funnel 346, they may be similarly configured for other types of holders.

The first fastening formation 364 comprises a hook-shaped fastening formation positioned near the upper end of the funnel. It extends horizontally along at least a portion of the holder. In the embodiment shown in FIG. 16, there are two spaced segments of the formation 364. The hook-shaped formation has a first portion (FIG. 17A) projecting rearward from the holder and a second portion projecting generally vertically down from the first portion, and is sized for engaging the upper edge 334 of the front panel 310.

The second fastening formation 366 (i.e., the snap-lock fastening formation) comprises a tab projecting from the holder near the lower end of the funnel for resilient snap-fastening engagement with the mount 310. In the illustrated embodiment, the tab 366 is positioned for engaging the lower edge 336 of the front panel 310. It is understood that it could engage another portion of the rail without departing from the scope of this invention. The tab is configured to be resiliently deflectable. A locking member 370 is positioned on the tab. In the illustrated embodiment, the locking member 370 comprises a protuberance.

To fasten the holder 346 to the mount, a person first places the hook-shaped fastening formation 364 in engagement with the upper edge 334. Next, the lower portion of the holder is moved toward the fastened position (as shown in FIG. 17B). As it moves, the tab 366 deflects such that the locking member 370 is free to move from an initial position engaging the front face 330 of the mount, past the lower edge 336, and to a position engaging the back face 332 of the mount whereupon the tab snaps back toward an undeflected position, thereby releasably fastening the holder at the fastened position. A spacing between the hook-shaped fastening formation 364 and the tab 366 is such that when the holder is placed at the fastened position, the fastening formation 364 and tab 366 exert a clamping force against the upper and lower edges 334, 336 to hold the holder in the fastened position.

The tab 366 also functions as a release for unfastening the holder from the mount. A person pulls on the end of the tab to release the locking member from its position and remove the holder.

A support 380 of the invention may be used to place a holder at a different position relative to the rail 302 (e.g., at a different vertical position). The support 380 is mountable on the rail and adapted for releasably supporting an implement holder thereon. The support 380 has a snap-fastening formation adapted to engage the rail at a fastening location. The support extends downward from its fastening location and is adapted for releasably supporting the holder at an elevation wherein at least a portion of the holder is mounted below the fastening location. Alternatively, the support can extend upward (not shown) from its fastening location and is adapted for releasably supporting the holder at an elevation wherein at least a portion of the holder is mounted above the fastening location.

In one embodiment, the support 380 includes a rail fastening section 382 having a snap-fastening formation 383 (FIG. 21) configured for releasable mounting on the rail, and a holder mounting section 384 for releasably mounting a holder. The formation 383 comprises a protuberance. The holder mounting section has a vertical platform 388 connected at its upper end to the rail fastening section by a C-shaped connecting strip 390. Significantly, the holder mounting section is configured to have the same height as the front panel 310 such that a holder can be mounted to either the front panel or the support. The rail fastening section has a front surface generally coplanar with the platform 388 of the holder mounting section. An upper tab extension 394 reaches into the enclosed portion of the channel-track 312, for greater stability. A stabilizer leg 396 is for engagement with a vertical wall 304. Alternatively, the support can be suspended from the rail, without engaging a wall. In one embodiment, the support comprises a one-piece molded body.

Figure 18:
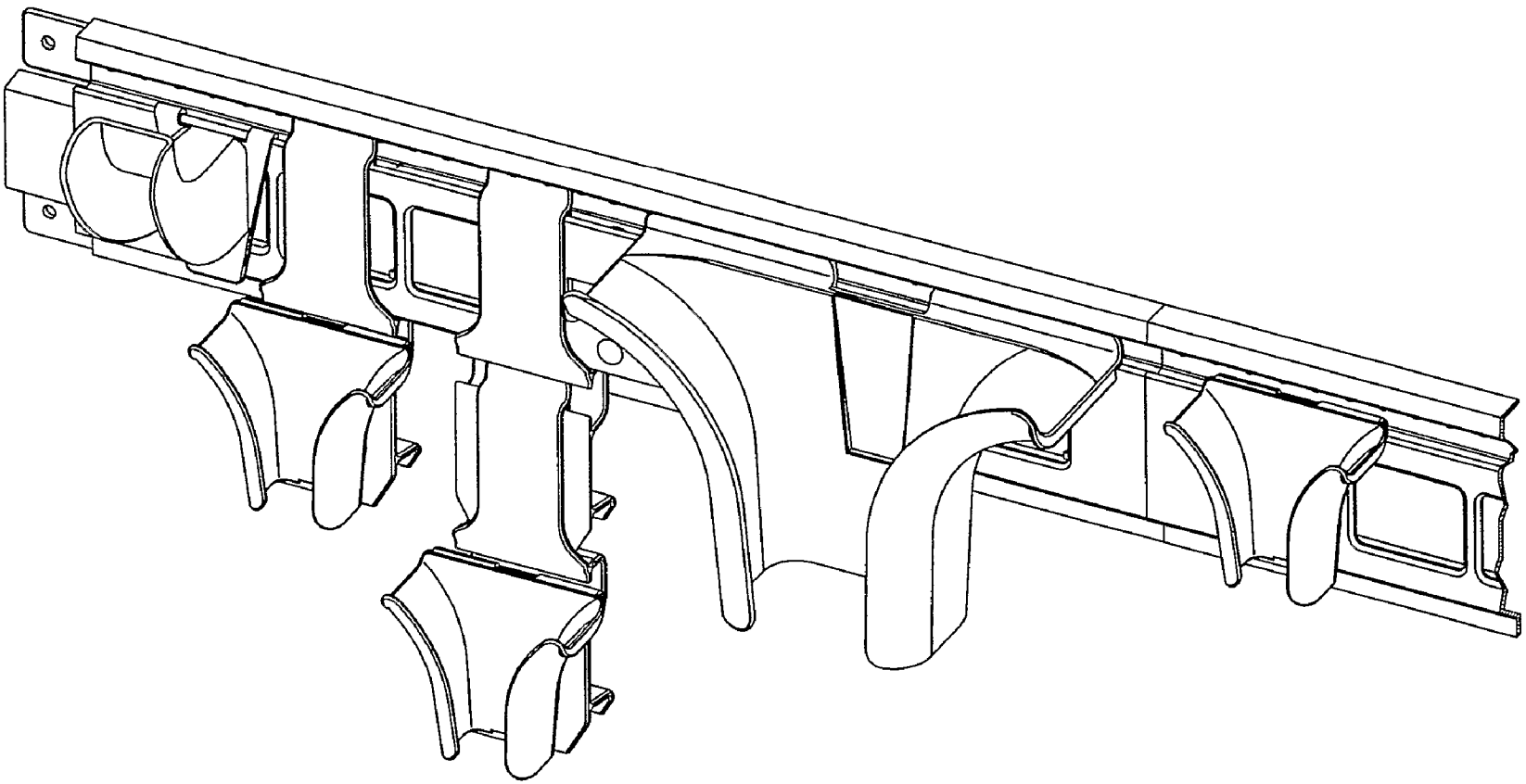
FIG. 18 is a front perspective of implement holders attached at several heights relative to the rail.
Figure 19:
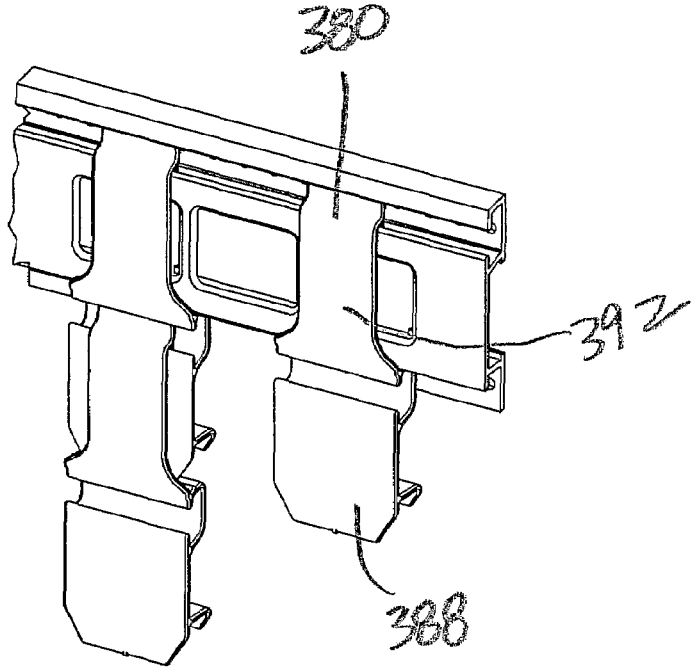
FIG. 19 is a front perspective of hanger supports fastened to the rail.
Figure 20A:
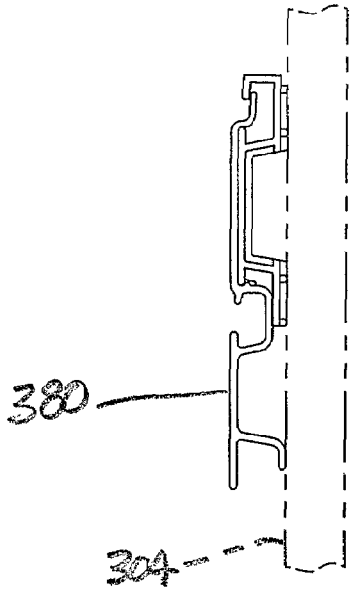
FIG. 20A is a side elevation of a single support fastened to the rail.
Figure 20B:
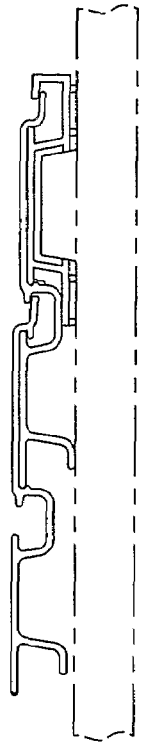
FIG. 20B is a side elevation of two supports mounted in series arrangement and fastened to the rail.
Figure 21:
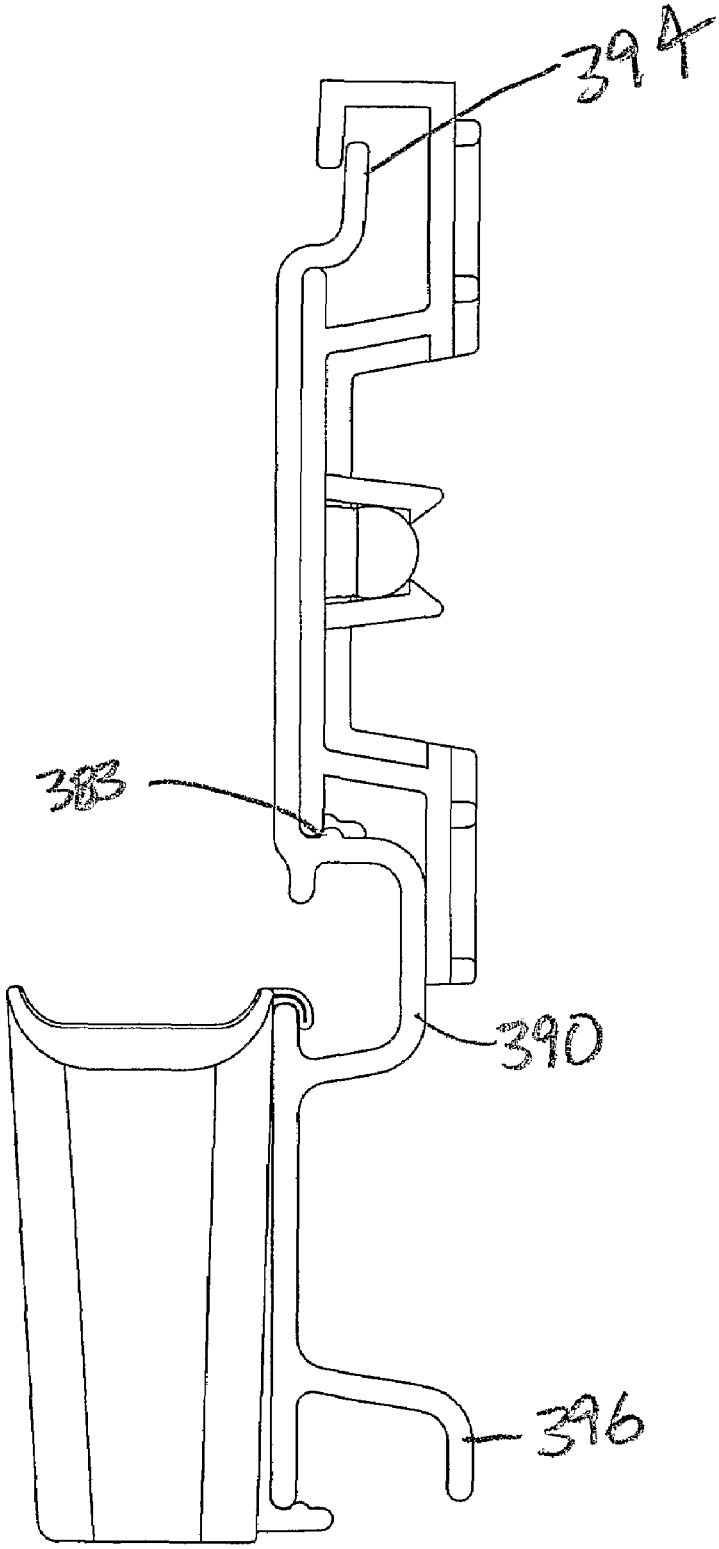
FIG. 21 is a side elevation of the funnel-shaped holder of FIG. 15 mounted on a hanger support.

Multiple supports 380 may be cascaded in a series arrangement, as shown in FIGS. 18 and 19, to increase the spacing from the rail. A second support is mounted on the first support for supporting the holder by both first and second supports.

Figure 23A:
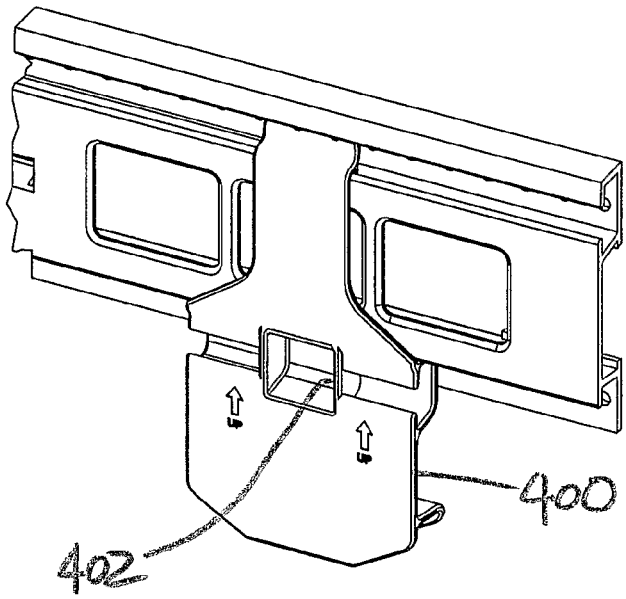
FIG. 23A is a front perspective of a support of another embodiment fastened to the rail.
Figure 23B:
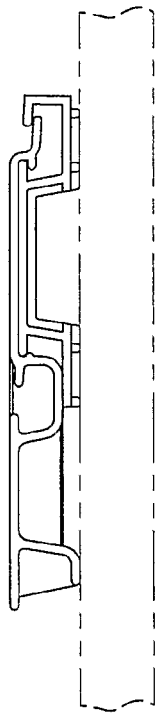
FIG. 23B is a side elevation of the support and rail.
Figure 23C:
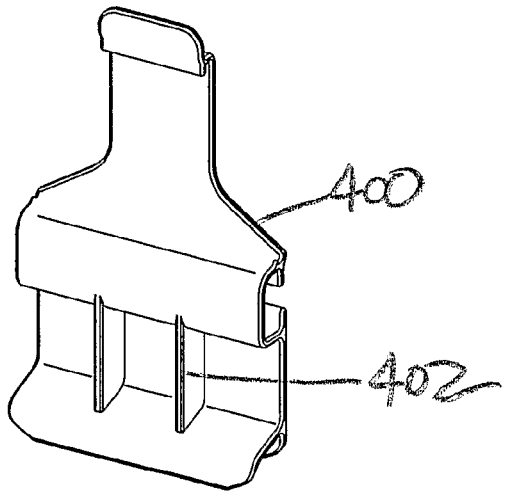
FIG. 23C is a rear perspective of the holder of FIG. 23A.

An alternate embodiment 400 of the support is shown in FIGS. 23A-23C. Vertical ribs 402 are positioned on front and back sides. A positioning system is on the support and holder for preventing lateral shifting of the holder relative to the support. The spacing between the two segments of the hook-shaped fastening formation are spaced to match the spacing around the ribs 402. Other types of positioning systems do not depart from the scope of this invention (e.g., detents).

Figure 22A:
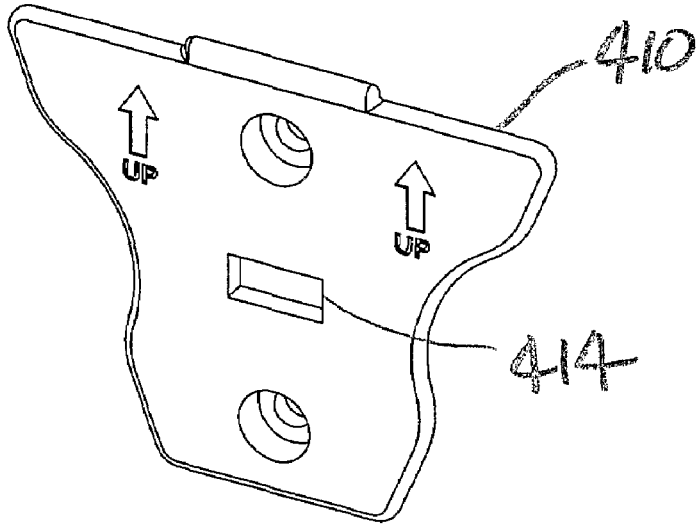
FIG. 22A is a front perspective of a wall mount.
Figure 22B:
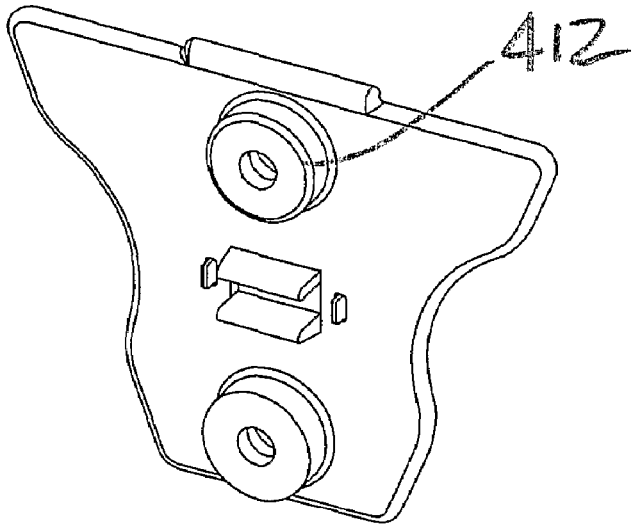
FIG. 22B is a rear perspective of the wall mount of FIG. 22A.
Figure 22C:
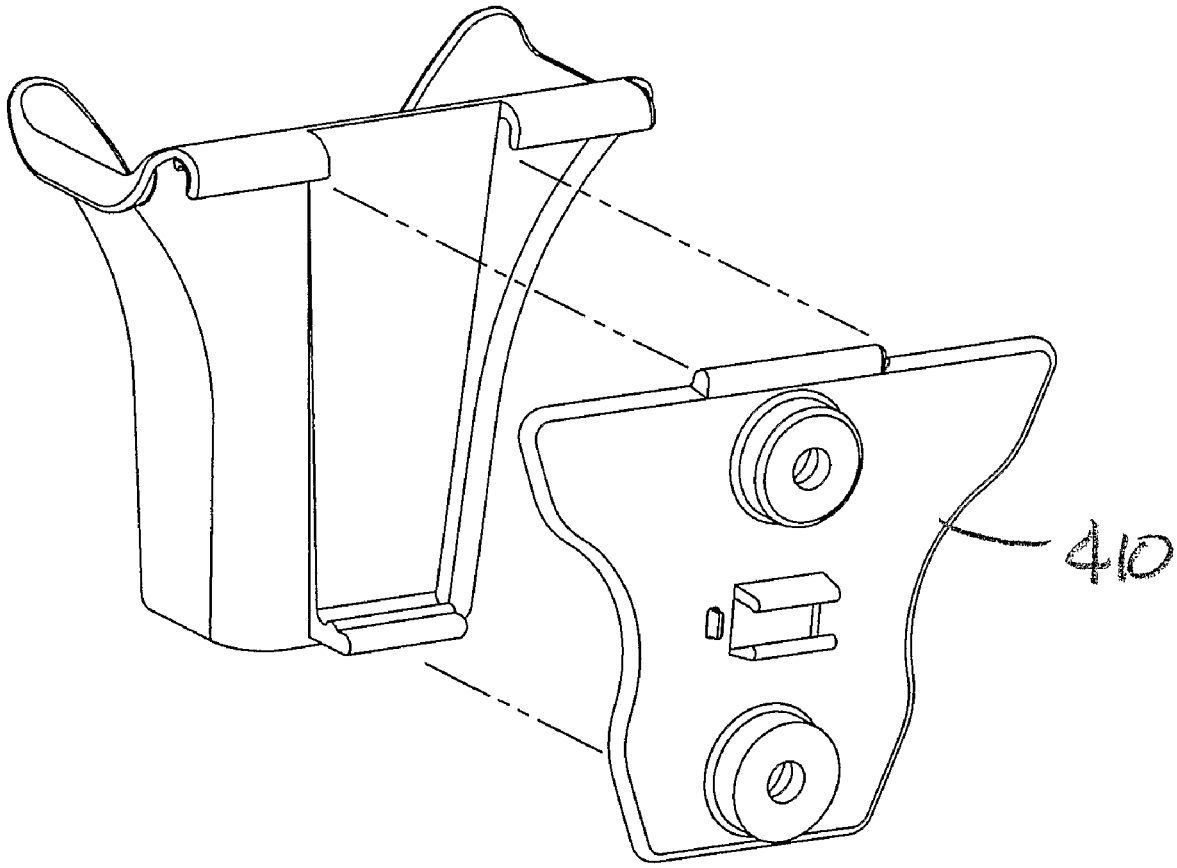
FIG. 22C is an exploded rear perspective of a holder and the wall mount.

Referring to FIG. 22A-22C, a wall mount 410 of the invention is adapted to be mounted on a generally vertical mounting surface. In the embodiment shown in the drawings, the wall mount 410 comprises a generally flat bracket, although other configurations are possible. The wall mount bracket includes one or more bosses 412 on its back side with an opening for receiving a fastener to fasten the wall mount bracket to a wall. The wall mount is used instead of the rail, and it has the same height dimension as the front panel 310.

Implement holders with a snap-lock formation may be releasably snap-fastened to the wall mount. The wall mount and holder also have the positioning system, as shown in FIG. 22C, for preventing lateral shifting of the holder relative to the wall mount bracket. The wall mount may include a level at its center window 414.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions without departing from the scope of the invention, it is intended that all matter contained in the above description and shown in the accompanying drawing[s] shall be interpreted as illustrative and not in a limiting sense.

What is claimed is:

1. A system for holding one or more implements, said system comprising:

a mount comprising a rail adapted to be mounted in a generally horizontal orientation on a generally vertical mounting surface;

said rail having a front face adapted to face away from said mounting surface, a back face adapted to face toward said mounting surface, and first and second spaced-apart edges extending generally horizontally and parallel to one another along the rail, an implement holder configured to hold said one or more implements, the holder having a hook-shaped fastening formation engageable with the first edge of the rail and at least one snap-lock fastener engageable with the second edge of the rail for snap-fastening engagement with the rail to releasably fasten the holder at a fastened position on the rail with the hook shaped-fastening formation and snap-lock fastener exerting a clamping force against respective edges of the rail to grip a portion of the rail between said edges and thereby resist relative movement of the holder along the rail, and wherein said holder comprises:

a funnel structure having an upper end that flares open upwardly for receiving said implement, a lower end that is narrower than said upper end, a rear wall with an inside surface and an outside surface, and opposite converging side walls which define, in conjunction with said rear wall, a funnel-shaped recess for holding said implement in a stored position;

said hook-shaped fastening formation projecting rearward from the rear wall for engagement with said first edge of the rail; and said snap-lock fastener projecting rearward from the rear wall and positioned in spaced relation from the hook-shaped fastening formation for engagement with said second edge of the rail.

2. A system as set forth in claim 1 wherein said snap-lock fastener comprises a tab having a locking member thereon for engagement with said second edge of the rail, the tab being resiliently deflectable for deflection as the holder is moved past said second edge of the rail and thereafter snaps back toward an undeflected position wherein the locking member cannot move past said second edge.

3. A funnel-shaped holder as set forth in claim 2 wherein said locking member comprises a protuberance on the tab.

4. A system for holding one or more implements, said system comprising a rail adapted to be mounted in a generally horizontal orientation on a generally vertical mounting surface, said rail having at least one channel-track extending along the rail, said channel-track comprising a bottom wall with a plurality of fastener holes therein along the channel-track for receiving one or more fasteners to mount the rail on said mounting surface, first and second slots in the rail extending along the rail, first and second edges on the rail extending generally horizontally and parallel to one another along said first and second slots, respectively, an implement holder configured to hold said one or more implements, the holder having track-engaging elements comprising at least one hook-shaped fastening formation adapted to extend into said first slot and to engage said first edge of the rail and at least one snap-lock fastener adapted to extend into said second slot and to engage said second edge of the rail whereby the at least one hook shaped-fastening formation and the at least one snap-lock fastener exert a clamping force against respective edges of the rail resisting relative movement of the holder along the rail, said at least one channel-track having a depth sufficient to provide clearance between one of the track-engaging elements received in said channel-track and said one or more fasteners when the rail is mounted on said surface whereby the track-engaging element is movable along the channel-track without interference with said one or more rail fasteners.

5. A system as set forth in claim 4 wherein said rail comprises an elongate rail panel having a front face adapted to face away from said mounting surface and a back face adapted to face said mounting surface, wherein said channel-track is disposed on the back face of the rail panel, and wherein said first and second edges comprise upper and lower edges of said rail panel.

* * * * *